US009102508B2

(12) United States Patent
O'Keefe, Jr. et al.

(10) Patent No.: US 9,102,508 B2
(45) **Date of Patent: *Aug. 11, 2015**

(54) WINE DISPENSING SYSTEM

(71) Applicant: Emerald Wine Systems, LLC, Traverse City, MI (US)

(72) Inventors: Edward L. O'Keefe, Jr., Traverse City, MI (US); Robert G. Kalik, Bethesda, MD (US); Karl Fritze, Hastings, MN (US)

(73) Assignee: Edward L. O'Keefe, Traverse City, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/168,721

(22) Filed: Jan. 30, 2014

(65) Prior Publication Data

US 2014/0144935 A1 May 29, 2014

Related U.S. Application Data

(63) Continuation of application No. 13/364,070, filed on Feb. 1, 2012, now Pat. No. 8,640,931.

(60) Provisional application No. 61/438,500, filed on Feb. 1, 2011, provisional application No. 61/438,503, filed on Feb. 1, 2011.

(51) Int. Cl.

| | |
|---|---|
| ***B67D 7/78*** | (2010.01) |
| ***B67D 1/00*** | (2006.01) |
| ***B67D 3/04*** | (2006.01) |

(52) U.S. Cl.

CPC ..... *B67D 1/0004* (2013.01); *B67D 3/043* (2013.01)

(58) Field of Classification Search

CPC .... B67D 1/0005; B67D 1/108; B67D 1/0004; B67D 2001/0827; G01F 11/125

USPC ..... 222/132, 135, 144.5, 146.6, 173, 23, 222/325–327, 101, 105, 214, 14, 30, 36, 37, 222/52; 417/474–476, 477.12, 480, 412

See application file for complete search history.

(56) References Cited

U.S. PATENT DOCUMENTS

| | | | | | |
|---|---|---|---|---|---|
| 888,406 | A | * | 5/1908 | Neely | 62/258 |
| D91,822 | S | * | 3/1934 | Harazen | D7/301 |
| 2,177,278 | A | | 10/1939 | Hill et al. | |
| D144,931 | S | * | 6/1946 | Paley | D7/306 |
| 2,668,637 | A | * | 2/1954 | Gilmore | 222/95 |
| 2,929,535 | A | * | 3/1960 | Fairbanks | 222/394 |
| D190,599 | S | * | 6/1961 | Gardner | D7/306 |
| 3,597,124 | A | | 8/1971 | Adams | |
| 3,750,908 | A | * | 8/1973 | Bauerlein et al. | 222/80 |
| 3,777,937 | A | * | 12/1973 | Buck | 222/641 |
| 3,827,467 | A | * | 8/1974 | Henley et al. | 141/104 |
| 3,940,019 | A | * | 2/1976 | Kross et al. | 222/30 |
| 4,142,845 | A | | 3/1979 | Lepp et al. | |

(Continued)

*Primary Examiner* — Frederick C Nicolas
*Assistant Examiner* — Randall Gruby
(74) *Attorney, Agent, or Firm* — A. Robert Weaver; Feldman Gale, P.A.

(57) ABSTRACT

A wine dispensing system comprises a cabinet with refrigerated compartments for maintaining bulk wine in boxes and dispenses any one of a number of wine varieties upon pressing an appropriate button. Check valves in the system prevent air from spoiling unused wine, and a computer measures each pour, updates inventory, and accepts demographic information to assist in marketing and sales promotion.

17 Claims, 29 Drawing Sheets

(56) References Cited

U.S. PATENT DOCUMENTS

| | | | | |
|---|---|---|---|---|
| 4,179,249 | A | 12/1979 | Guttmann | |
| 4,334,640 | A * | 6/1982 | van Overbruggen et al. | 222/207 |
| 4,433,795 | A * | 2/1984 | Maiefski et al. | 222/14 |
| 4,477,003 | A * | 10/1984 | Baker et al. | 222/642 |
| 4,559,040 | A | 12/1985 | Horres et al. | |
| D283,827 | S * | 5/1986 | Albright | D20/4 |
| 4,628,974 | A | 12/1986 | Meyer | |
| 4,708,266 | A * | 11/1987 | Rudick | 222/105 |
| 4,717,047 | A | 1/1988 | van Overbruggen et al. | |
| 4,747,516 | A * | 5/1988 | Baker | 222/129.1 |
| 4,776,495 | A * | 10/1988 | Vignot | 222/207 |
| 4,779,761 | A | 10/1988 | Rudick et al. | |
| 4,961,533 | A | 10/1990 | Teller et al. | |
| 4,982,881 | A | 1/1991 | Amrein | |
| 5,000,352 | A * | 3/1991 | Cleland | 222/129.2 |
| 5,056,686 | A * | 10/1991 | Jarrett | 222/129.2 |
| 5,067,636 | A | 11/1991 | Pfeiffer et al. | |
| 5,114,045 | A * | 5/1992 | Herpe | 222/105 |
| 5,199,604 | A * | 4/1993 | Palmer et al. | 222/25 |
| 5,333,759 | A * | 8/1994 | Deering | 222/129.1 |
| 5,349,825 | A | 9/1994 | Duke et al. | |
| 5,390,814 | A * | 2/1995 | Christine et al. | 222/105 |
| 5,564,601 | A * | 10/1996 | Cleland et al. | 222/129.1 |
| 5,566,732 | A * | 10/1996 | Nelson | 141/94 |
| 5,575,405 | A * | 11/1996 | Stratton et al. | 222/1 |
| 5,603,363 | A * | 2/1997 | Nelson | 141/351 |
| 5,803,317 | A | 9/1998 | Wheeler | |
| 6,003,733 | A | 12/1999 | Wheeler | |
| 6,012,611 | A * | 1/2000 | Schroeder | 222/105 |
| 6,142,340 | A * | 11/2000 | Watanabe et al. | 222/66 |
| 6,155,465 | A | 12/2000 | Steiger | |
| 6,170,707 | B1 * | 1/2001 | Wolski et al. | 222/129.1 |
| 6,216,918 | B1 * | 4/2001 | Saveliev et al. | 222/148 |
| 6,321,948 | B1 | 11/2001 | Bellon et al. | |
| 6,354,341 | B1 * | 3/2002 | Saveliev et al. | 141/94 |
| 6,354,342 | B1 * | 3/2002 | Gagliano | 141/94 |
| 6,419,121 | B1 | 7/2002 | Gutierrez et al. | |
| 6,419,466 | B1 | 7/2002 | Lowe et al. | |
| 6,422,422 | B1 * | 7/2002 | Forbes | 222/66 |
| 6,443,335 | B1 * | 9/2002 | Pinedjian et al. | 222/504 |
| 6,561,386 | B1 | 5/2003 | Martens | |
| 6,607,100 | B2 | 8/2003 | Phelps et al. | |
| 6,607,105 | B2 | 8/2003 | Phelps et al. | |
| 6,698,621 | B2 | 3/2004 | Landers et al. | |
| D491,580 | S * | 6/2004 | Stoddart | D15/79 |
| 6,758,457 | B2 | 7/2004 | Nicolino et al. | |
| 6,913,167 | B2 | 7/2005 | Phelps et al. | |
| 6,938,801 | B1 | 9/2005 | Reddy et al. | |
| 7,076,966 | B2 * | 7/2006 | Mullen | 62/337 |
| 7,147,134 | B2 | 12/2006 | Gutierrez et al. | |
| 7,244,580 | B2 | 7/2007 | Gershwin et al. | |
| 7,278,553 | B2 | 10/2007 | Py et al. | |
| 7,356,381 | B2 | 4/2008 | Crisp, III | |
| 7,439,859 | B2 | 10/2008 | Humphrey | |
| 7,503,592 | B2 | 3/2009 | Durieux et al. | |
| 7,555,980 | B2 * | 7/2009 | Howard et al. | 99/407 |
| 7,651,010 | B2 * | 1/2010 | Orzech et al. | 222/214 |
| 7,681,764 | B2 | 3/2010 | Nini | |
| 7,712,631 | B2 | 5/2010 | Taradalsky et al. | |
| 7,721,755 | B2 | 5/2010 | Smith et al. | |
| 7,762,431 | B1 * | 7/2010 | Tuyls et al. | 222/146.6 |
| 7,768,396 | B2 | 8/2010 | Teller | |
| 7,779,099 | B2 | 8/2010 | Raghunathan et al. | |
| 8,006,874 | B2 | 8/2011 | Smith et al. | |
| 8,104,644 | B2 | 1/2012 | Py et al. | |
| 8,322,570 | B2 | 12/2012 | Beavis et al. | |
| 8,550,310 | B2 | 10/2013 | Alstad et al. | |
| 2003/0213814 | A1 * | 11/2003 | Phelps et al. | 222/146.6 |
| 2004/0056054 | A1 | 3/2004 | Ottolangui | |
| 2006/0009610 | A1 * | 1/2006 | Hayes | 528/272 |
| 2006/0037969 | A1 | 2/2006 | Jennings et al. | |
| 2006/0118581 | A1 * | 6/2006 | Clark | 222/333 |
| 2007/0181602 | A1 * | 8/2007 | Taradalsky | 222/152 |
| 2007/0210155 | A1 * | 9/2007 | Swartz et al. | 235/383 |
| 2007/0228068 | A1 * | 10/2007 | Schneider et al. | 222/1 |
| 2007/0233567 | A1 | 10/2007 | Daly | |
| 2008/0054015 | A1 | 3/2008 | Moezidis | |
| 2008/0245816 | A1 | 10/2008 | Armstrong et al. | |
| 2008/0314930 | A1 | 12/2008 | Green | |
| 2009/0040050 | A1 | 2/2009 | Humphrey | |
| 2009/0236361 | A1 * | 9/2009 | Doelman et al. | 222/1 |
| 2009/0276088 | A1 * | 11/2009 | Ruddy | 700/232 |
| 2010/0116842 | A1 | 5/2010 | Hecht et al. | |
| 2010/0170916 | A1 | 7/2010 | Segers | |
| 2010/0176147 | A1 | 7/2010 | Segers | |
| 2010/0206400 | A2 | 8/2010 | Winlker | |
| 2010/0276452 | A1 | 11/2010 | Vesborg et al. | |
| 2011/0011888 | A2 | 1/2011 | Beavis et al. | |
| 2011/0011897 | A1 | 1/2011 | Bellmore et al. | |
| 2011/0100049 | A1 | 5/2011 | Bax | |
| 2011/0315711 | A1 | 12/2011 | Hecht et al. | |

* cited by examiner

WINE DISPENSING SYSTEM

CROSS-REFERENCE TO RELATED APPLICATIONS

This application is a continuation of U.S. patent application Ser. No. 13/364,070, filed Feb. 1, 2012, which is based upon, and claims priority from U.S. provisional application No. 61/438,503 and U.S. provisional application No. 61/438,500, each filed Feb. 1, 2011, the disclosures of which are hereby incorporated by reference in their entireties.

FIELD OF THE DISCLOSURE

The present invention relates to systems for dispensing wine by the glass or carafe from flexible, collapsible containers while maintaining accurate inventory control and pouring accuracy while minimizing product spoilage and theft.

BACKGROUND

The traditional way of dispensing wine is by the bottle. It is also desirable to be able to sell wine by the glass. This is difficult when wine is packaged in bottles only, because wine is notoriously susceptible to oxygen degradation over a very short period of time. Thus, if a glass of wine is purchased by a buyer, the rest of the bottle will have to be thrown away if it is not consumed in a relatively short period of time of a few hours. The packaging for wine in bottles also presents a substantial cost.

There have been some developments in apparatus for prolonging the life of a bottle of wine when the wine is served by the glass. In one method, wine is served by the bottle, but the bottles are purged with nitrogen or another non-oxygen gas. These systems provide an extended life of the wine, but generally not more than a few weeks.

Another problem with dispensing wine by the glass is that it is difficult to control the quantity of wine poured in each glass and make the pourings consistent. Theft and other misuse of the wine is also difficult to track.

Accordingly, and improved beverage dispensing system for dispensing an environmentally sensitive beverage, such as wine, is desired.

BRIEF SUMMARY OF THE DISCLOSURE

The following presents a simplified summary of the disclosure in order to provide a basic understanding of some aspects of the invention. This summary is not an extensive overview of the invention. It is intended to neither identify key or critical elements of the invention nor delineate the scope of the invention. Its sole purpose is to present some concepts of the invention, in accordance with the disclosure, in a simplified form as a prelude to the more detailed description that is presented later.

The wine dispensing cabinet of this invention has a number of dispensing taps that dispense a number of different wines from either of two refrigerated compartments. In the preferred embodiment, up to eight wines can be maintained in the cabinet and dispensed from individual nozzles. The cabinets are independently temperature-adjustable, and white wines that are typically served at colder temperatures can be maintained at an appropriate temperature in one of the compartments while red wines can be maintained at a higher temperature in the other compartment. Thus, in a preferred embodiment, eight taps dispense varietal wines including merlot, chardonnay, riesling, cabernet sauvignon, pinot grigio, sauvignon blanc, pinot noir and zinfandel at recommended temperatures.

The wines are provided to the cabinet in plastic oxygen non-permeable bags enclosed in boxes. Each wine carton is one-third the size of a case of wine in bottles and is approximately half the weight. (Each box weighs approximately 20 pounds compared to a case of bottled wine, which weighs approximately 40 pounds). A spout extends from each bag to a connection fixture at the front of the box, and a connecting tube having a one-way check valve carries wine from the refrigerated compartment to a pump, where portions are measured, recorded, and dispensed to one of the taps. The cabinet uses one or more pumps, and in the preferred embodiment is configured to use a separate pump for each tap. The quantity of wine dispensed can be determined by using a flow meter for each hose, or a single flow meter attached to a single pump; or the quantity can be determined by timing the flow where a constant-flow pump is used. In one embodiment, the dispenser features electronic, automatic portion control: It measures accurate pours of wine in three programmable amounts and records the total ounces poured in each brand of wine for each day as well as the times of each pour.

Wine from the wine boxes is delivered to the pumps through delivery hoses that are connected to internal hoses that have check valves in the hardware connecting them. Check valves are used to prevent the backflow of wine through the hoses and to prohibit the introduction of air (oxygen) into the lines when they are being attached or detached.

A bar code is affixed to each box or its label. The bar code has a large capacity for information, and may include the amount of wine contained in the box, the brand and type of wine contained in the box, the identification of each box and the date it is tapped. The bar code can be read by a bar-code scanner that may be detachable or may be built into the wine dispensing cabinet. The wine box then is placed in slot 1 through 8 in the machine. When a new box is placed into a specific slot, a sensor registers the location of the box in the machine and reports that information to a computer, described in greater detail below. The position of the box on the shelf correlates to a specific pump, which will track how much wine is drawn from that box. Thus, the computer identifies the box and its contents when the bar code is scanned, and then the computer identifies the box's location in the machine via the sensor. This knowledge allows the machine to track each pour from each box via the data processor as the box is drained. If the box should be removed and replaced in a different slot in the compartment, the sensor will alert the computer to the new location, and information regarding that box will be maintained and updated.

A computer may be included in the wine dispensing cabinet. Where this is done, the computer can be used to perform a variety of functions including: scanning barcodes on wine boxes to determine the type of wine, the supplier, the cost, or other information relevant to the type of wine; recording the amount of wine dispensed from each box; recording and making adjustments to inventory on a daily, weekly, or monthly basis; providing notification when any of the wines need to be restocked; receiving and recording information about customers, such as scanning drivers' licenses and determining the demographics of wine consumption cross-referenced with any of a number of demographic parameters; auditing usage and wastage; and any other information relevant to wine supply and consumption. Daily, weekly and monthly inventories of each brand poured can be determined which pinpoint the most popular brands or varieties poured each day, week or month. Such reports show how many ounces have been poured and compares that data with the wine remaining, providing an accurate, on-time inventory for use by management. The computer stores information obtained from each box's bar code and from the flow meter assigned to each box. The processor allows a direct PC interface via a cable or through a modem, which can transmit information to an on-premises computer or an off-premises system.

The dispenser's computer system utilizes a flow calculation system to monitor the volume of wine the machine dispenses and can be configured to produce cumulative and on-time sales reports by brand and volume.

When the box is removed, the machine registers its removal and remembers the amount of wine remaining in that box. A partially drained box may be re-scanned and again placed in the machine as much as a year later. When the box is re-scanned, the machine will identify it and remember which slot it originally was in. The computer will also recall how much wine the box should hold when it is replaced in the dispenser. If the box contains a different amount of wine than the computer remembers, the computer will report that information in the daily printout, which will apprise management that someone may have tampered with the box.

An optional driver's license scanner scans the face of a driver's license and captures demographic information, including name, age, sex and address. The information is uploaded to a fully customizable, multifunctional database that allows the operator to track consumption according to this information. This data allows the operator to identify and capitalize on customers' preferences. The system features a fully customizable, multifunctional database that includes easy sorting of data, advanced search options and easy data export. The search option allows users to filter data by any field, including name, address, sex and birth date. This information is uploaded to the computer system, where it can be analyzed according to the brand and variety poured for each customer, allowing the user to track popular brands and varieties of wine according to age, sex, address, and other point-of-sale (POS) information.

The computer may send POS information through a modem to off-premises locations as well as supplying information to the on-site computer. In this manner, the invention provides effective bar controls, prevents theft, and manages a large wine inventory without increasing the load on the management team.

The computer can also be programmed either to shut off pouring or indicate in the daily report when a box has been tampered with. The shut-off is the machine's default response to a box that contains less wine than it should. During normal operation, a box of wine is scanned by barcode and placed on the shelf. The machine, through its sensors, knows where in the machine the box is placed and tracks how much wine is removed from the box. The operator can remove and then re-scan and replace the box in any of the eight locations. The machine picks up exactly where it left off the last time it saw that particular box. If the total volume from that box is less than the recorded volume that's in the computer (with some margin), the machine can be programmed to shut off that pumping station. This is a programmable feature and the machine can respond in any number of ways to this situation. The owner may not desire a stoppage and instead it may only log the disparity in the daily report and continue dispensing.

The computer may also be configured to allow for customer self-serve operations. In one embodiment, a credit card reader is provided which allows patrons to purchase a glass of wine from the wine dispenser and serve themselves. This eliminates the necessity of a staff member running the machine.

The dispensing cart is easily movable, having at least 4 swivel rollers and a 360-degree turn radius, and is suitable for use in hotels and other semi-public facilities. The cabinet is constructed of commercial stainless steel and features a high-visibility, full-width display of available wines in their bottles, allowing customers to view potential selections prior to ordering.

The wine dispensing system can be operated from an external electrical power supply or using an optional rechargeable lithium battery. The unit can operate on battery power with the exception of the refrigerators, which will maintain temperature without power for approximately 3 hours. Thereafter, the operator only must plug the unit in to restore temperature or replace the wine with pre-chilled boxes. The dispenser can hold 8 cases of wine at one time, ensuring that additional chilled storage rarely is needed.

The wine dispensing machine of this invention enables customers to create their own wine blends in states that allow it. In this embodiment, customers would purchase re-usable glass bottles that are sandblasted with a proprietary, universal, pre-approved label, an individual's label or a winery's existing label. The wine bar provides a variety of wines and the necessary accoutrements for blending. Customers can create their own blends, and can record the percentages of each brand and variety. When the customer is satisfied with his or her blend, the percentage of each wine variety used can be recorded by the computer, where it will be kept on file for future bottling purposes. The system blends the customer's recipe and bottles it, then places the bottles into a 6-bottle wine carrier. The blending feature of the invention is suitable for use by individual customers, by restaurants, or by wine distributors or wholesalers.

Foreign wineries that wish to export their product to the United States have a difficult time obtaining representation. They first must convince a federal importer to import wine in the hopes a state importer and wholesaler will buy it and are able to sell it to a retailer. Small wineries don't interest wholesalers, who are interested in volume. Furthermore, the foreign winery must obtain federal and state label approval in accordance with TTB and state liquor control requirements. The foreign winery then must produce the wine, bottle the wine, label the wine and ship cases of the wine to the United States before they have a sale. Small foreign wineries are faced with a huge expense if the wine is not accepted by state importers, wholesalers or retailers. Smaller wineries cannot afford this risk. As a result, many small estates are hindered from entering the U.S. market. Additionally, both the small and larger wineries face uncertainty as to how their wines will be accepted in the U.S. market. The wine dispenser of the present invention solves this problem. The exporting winery must produce only a few containers of wine, and can ship it to a U.S. seller bearing a pre-approved universal label. The wholesaler can obtain the wines directly from Emerald's importer division, and then take the boxes directly to its proposed customers or to restaurant shows, where it can determine interest directly from restaurateurs who could place orders for the wine. The wholesaler would have all the information to make a sale—price, label, source of origin, etc. The restaurateurs would rate the wine they tasted and this information would provide the wholesaler with information regarding customer interest. Customers could taste the wines and provide their opinions to the restaurateur or retailer. These wines could be dispensed as tasting wines at no charge to the customer, saving on federal and state wine taxes. This would be done at a minimum cost to the exporting winery. This process would allow small foreign wineries to determine whether their wines are accepted in the U.S. market without incurring unnecessary expenses and risks.

DETAILED DESCRIPTION OF PREFERRED EMBODIMENTS

The following detailed description and the appended drawings describe and illustrate some embodiments of the invention for the purpose of enabling one of ordinary skill in the relevant art to make and use the invention. As such, the detailed description and illustration of these embodiments are purely illustrative in nature and are in no way intended to limit the scope of the invention, or its protection, in any manner. It should also be understood that the drawings are not to scale and in certain instances details have been omitted, which are not necessary for an understanding of the present invention, such as details of fabrication and assembly. In the accompanying drawings, like numerals represent like components.

Figure 1:
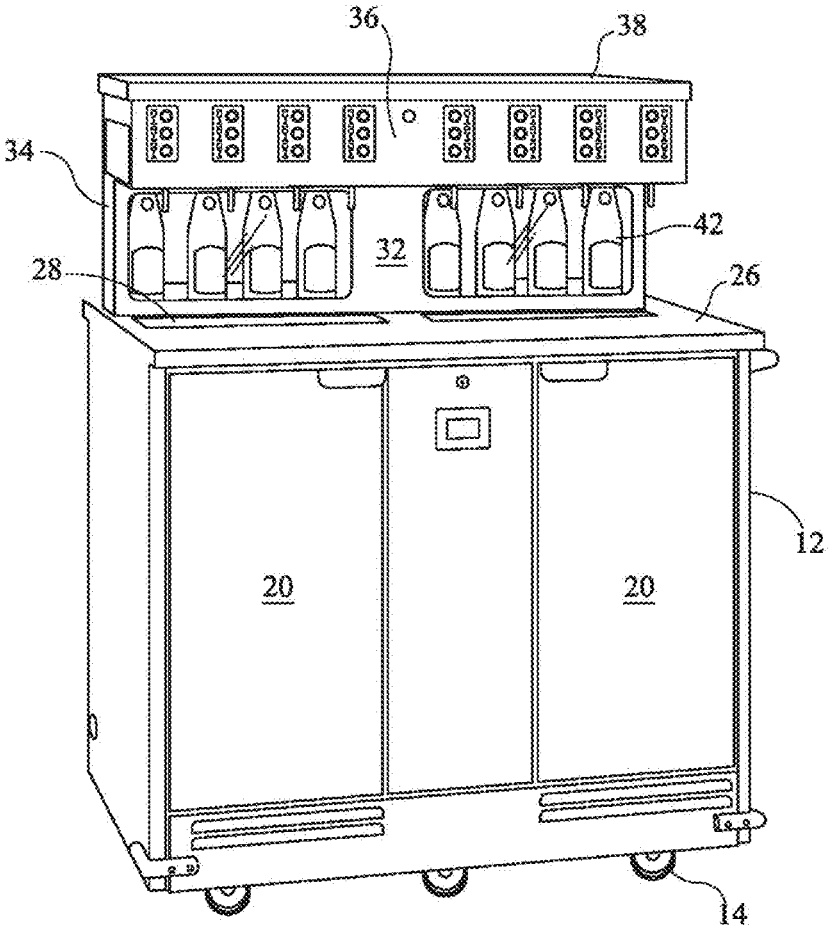
FIG. 1 is a perspective view of a wine dispenser cabinet in accordance with the present invention.
Figure 2:
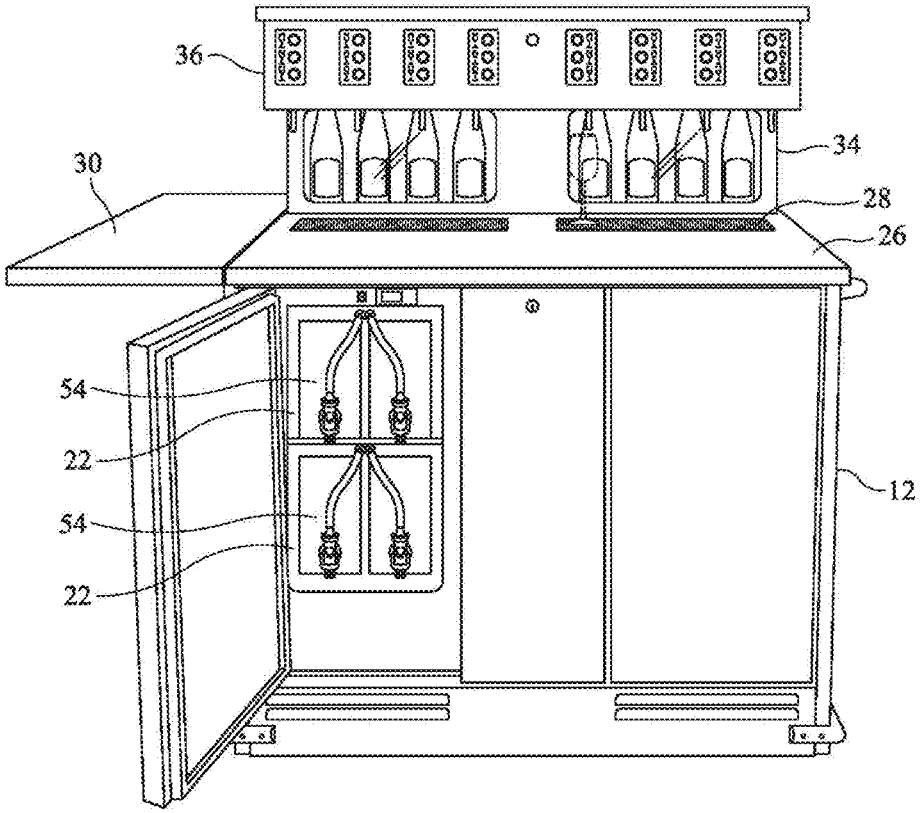
FIG. 2 is a perspective front view of the wine dispenser cabinet of FIG. 1, with one of the refrigerated compartment doors being shown in an open position.

Referring now to FIGS. 1 and 2, a wine dispenser constructed in accordance with the present invention comprises a stainless steel cabinet 12 mounted on wheels 14. The cabinet has an enclosed lower portion having an interior enclosed by hinged doors 20. The interior of the cabinet includes a number of storage receptacles 22 for retaining box wine containers 54. The interior of the cabinet also includes refrigeration equipment or other temperature control apparatus for maintaining one or more desirable temperatures in the interior of the cabinet.

The upper surface of the cabinet includes a countertop 26 at the front of the cabinet, and a drain panel 28 at the rear of the countertop for draining liquids or spillage from the counter. In one embodiment, a foldable end panel 30 is mounted on at least one side of the cabinet and can be raised to a horizontal position, as shown in FIG. 2, to serve as additional countertop surface. Alternatively, the panel can be folded downward into the side of the cabinet when not in use.

In a preferred embodiment, a wine dispensing housing is mounted on a rear portion of the cabinet and includes a vertical housing 34 extending upwardly from a rear side of the countertop and a forwardly extending dispenser housing 36 extending forwardly from the vertical housing. The vertical housing 34 serves as a display case to show bottles 42 representative of the wines being dispensed from boxes in the cabinet, with the vertical panel having a transparent panel at the front and an open interior behind the transparent panel for displaying bottles of wine.

Figure 3:
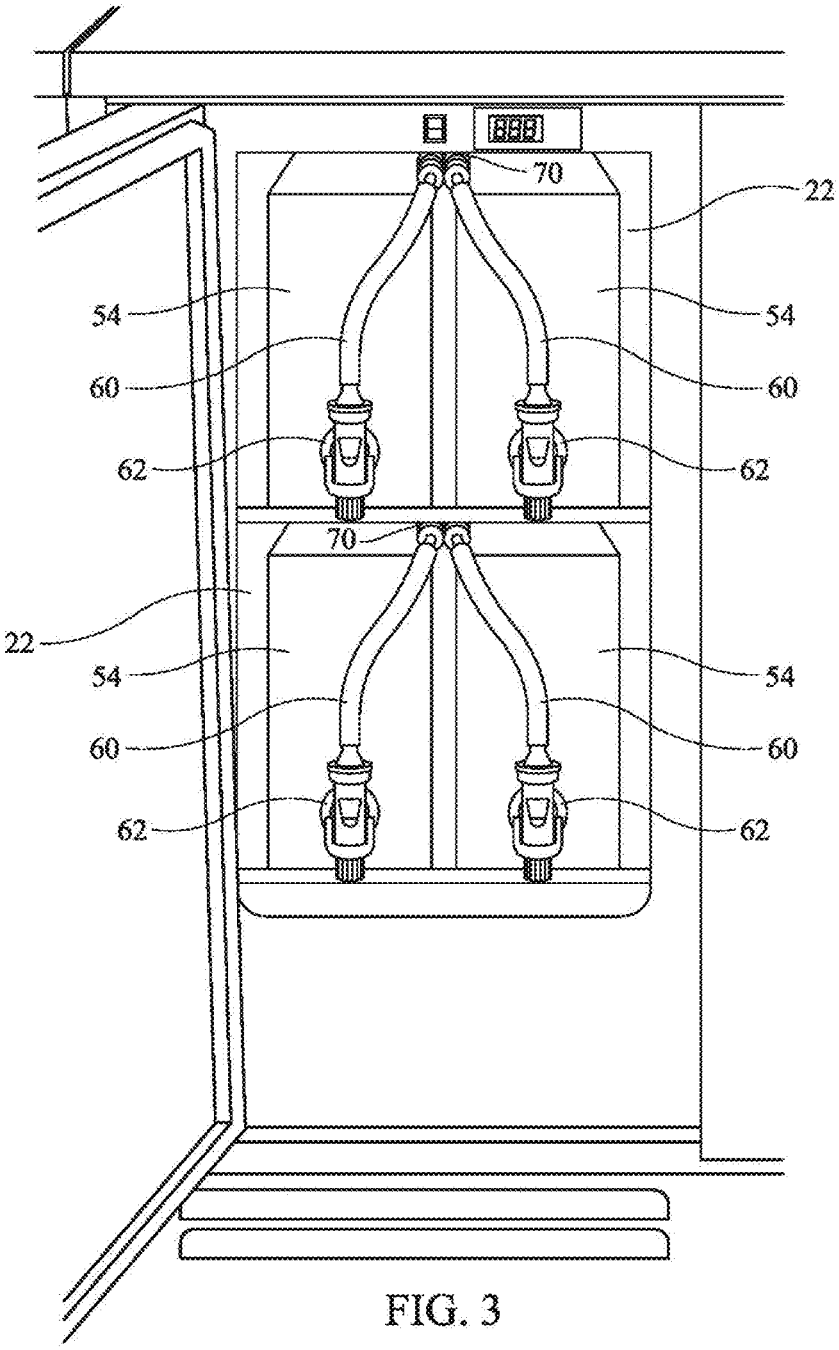
FIG. 3 is a perspective view of an open compartment of the wine cabinet of FIG. 1.

FIG. 3 shows a number of wine boxes 54 mounted in a refrigerated compartment 22 of the wine dispensing cabinet. When properly installed and connected, delivery hose 60 is attached to connector 62, and wine can be drawn from the box to the pump, and will be further dispensed into a glass. Delivery hose 60 is attached to internal hoses in the cabinet through a connector 70 that has an internal check valve. When delivery hose 60 is disconnected from the internal hosing, the check valve prevents wine from backflowing out of the connector and prevents air from entering into the cabinet hose.

Figure 4:
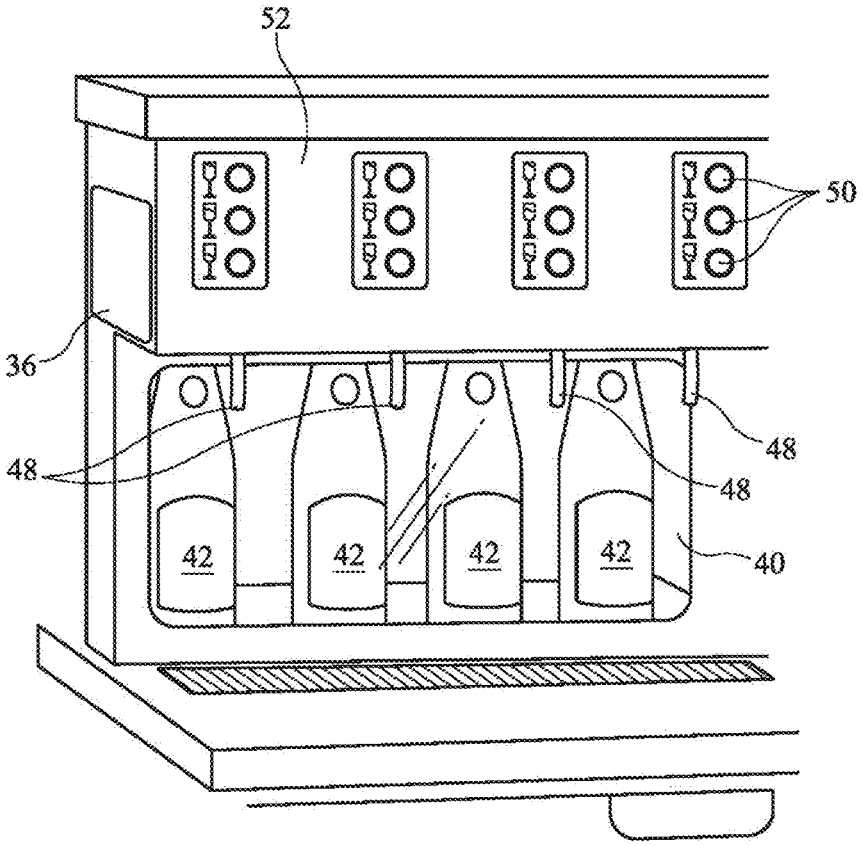
FIG. 4 is a perspective view of part of the front panel of the cabinet of FIG. 1.

One embodiment of the front panel 52 of the forwardly extending dispenser housing 36 is shown in FIG. 4. In a preferred embodiment, for each type of wine there are three automated choices that dispense varying quantities, namely a sample size, a normal size, and a large size. Persons of ordinary skill in the art will recognize that the number of choices and the amount of wine dispensed for each choice are not limited to those disclosed in the preferred embodiment. Also visible in FIG. 4 are the dispensing nozzles 48 from which wine is dispensed, and beneath which a wine glass will be placed to receive the wine. Representative bottles 42 are placed in a display area 40 to provide a visual indication of the kind of wine that will be dispensed from each nozzle 48.

Wine is dispensed in the present invention by button operated switches 50 mounted on a front panel 52 of the dispenser housing 36. In the preferred embodiment, the switches include three buttons that are preferably color coded and/or marked to represent different portion sizes. Each button actuates a timer that will cause the dispensing pump to operate for a precise period of time. Since the pump is a positive displacement pump, the amount of time that the pump is operated is used to precisely control the amount of liquid that is dispensed. By calibrating the pump with the time of operation, a precise pour amount can be determined for each operating button.

Operating buttons 50 can be programmed to operate for a predetermined period of time when depressed momentarily, or can be programmed to dispense in other ways. For example, the system could require that the button be continuously depressed to continue dispensing. This might prevent inadvertent spills. Alternatively, the system could provide for termination of an automatic pouring sequence by depressing multiple buttons simultaneously, for example.

In the illustrated embodiment, three separate buttons 50 are provided for each dispensing station. One button might be for a sample pour. Another might be for a one-half pour, and the other might be for a full pour. The number of ounces in each pour can be determined precisely, so that no overpouring or underpouring is done.

While a timed pump cycle is effective in controlling the portions poured, other portion control measures are known and could be employed. For example, a digital flow control mechanism responsive to the flow of liquid through a delivery tube could be employed to control the operation of the dispenser. Alternatively, the flow of wine may be metered, and the system configured to stop dispensing once a predetermined quantity of wine has been dispensed.

Figure 5:
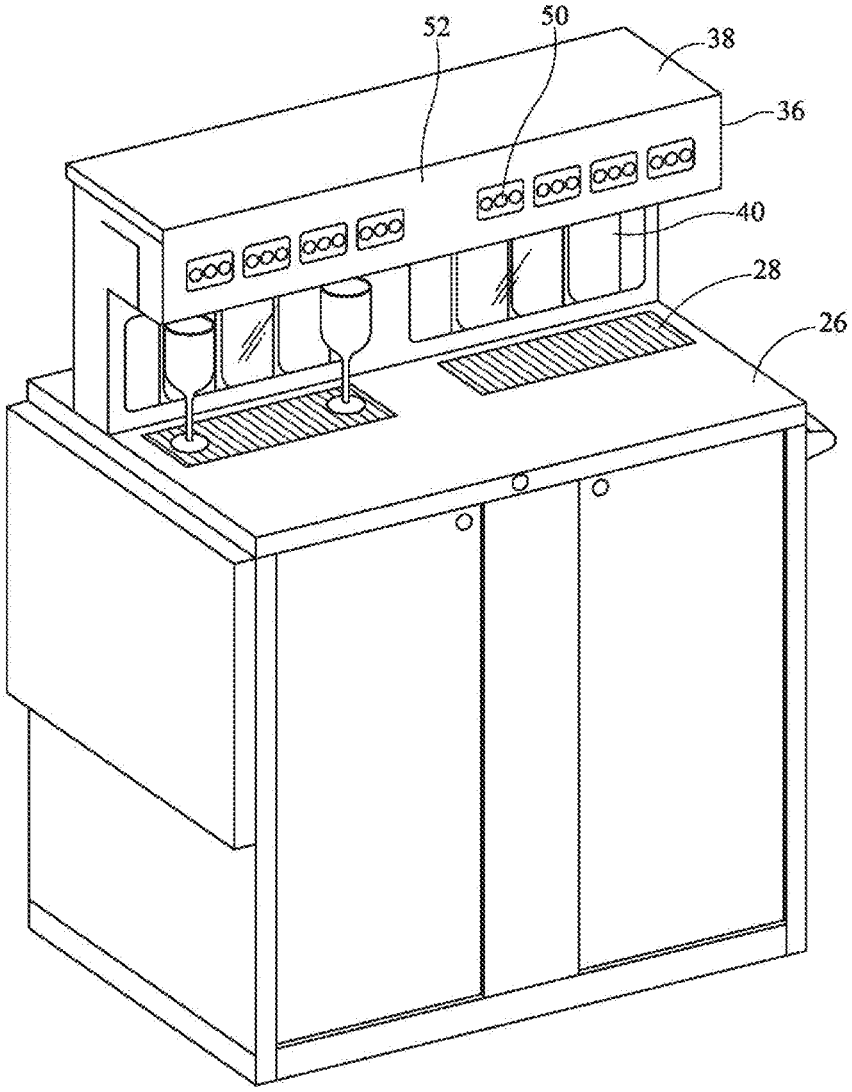
FIG. 5 is a perspective view of the wine cabinet of FIG. 1.

FIG. 5 depicts another embodiment of the front panel 52 of the forwardly extending dispenser housing 36. A top 38 may be removable, or may be hinged to allow access into the forwardly extending housing. FIG. 5 also shows a drain panel 28 built into countertop 26 whereby wine spills may be collected and cleanup can easily be performed. In this embodiment, buttons 50 on front panel 52 are arranged horizontally, rather than vertically.

Figure 6:
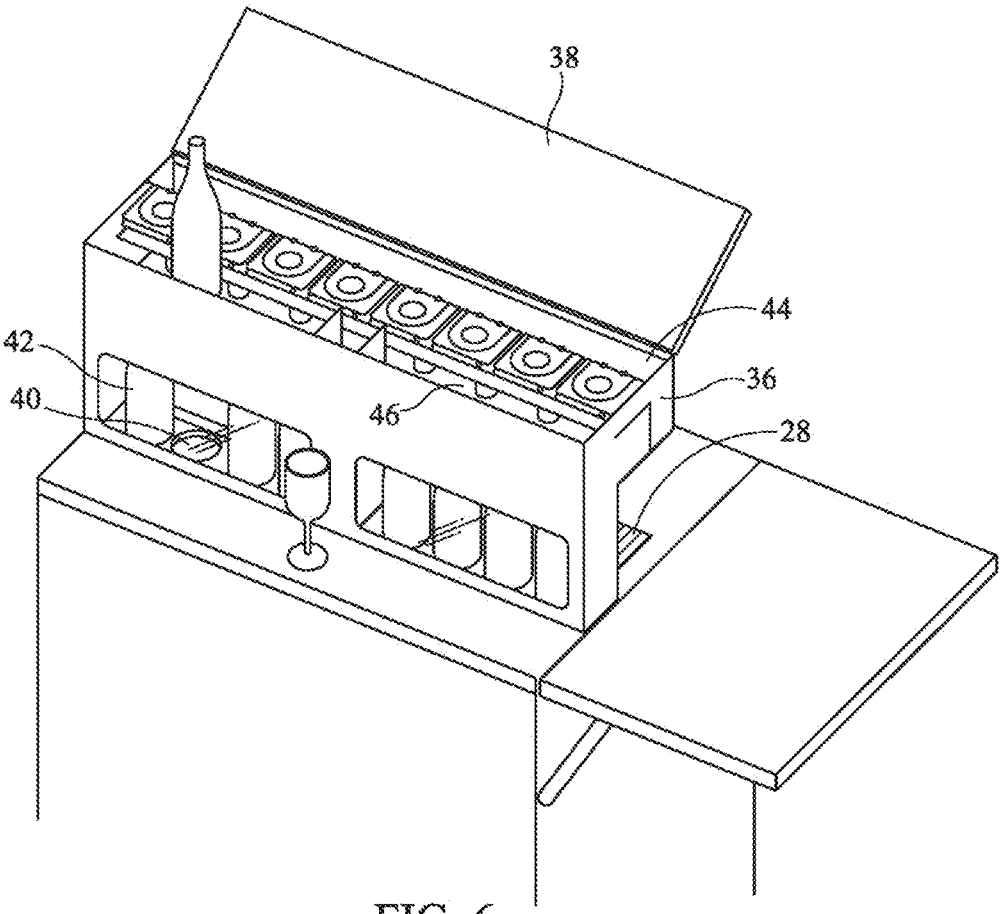
FIG. 6 is a rear perspective view of the top portion of the wine cabinet of FIG. 1, with the wine dispenser top being shown in an open position.

As shown in FIG. 6, top 38 opens to provide access to the interior of the forwardly extending vertical housing 36, so that representative wine bottles 42 can be placed into and removed from the display area 40. The interior of the front portion of dispenser housing 36 includes individual wine dispensers 44 located in the interior of the dispenser housing. Wine dispensers 44 include positive displacement pumps 46 that pump wine from each of the wine containers 54 to separate outlet nozzles 48 spaced along the underside of dispenser housing 36. Pumps 46 dispense a predictable, measured amount of liquid per unit time of operation. Thus, the amount of time the pump is operated can precisely control the amount of liquid dispensed. Such pumps are conventional. Peristaltic pumps may be used to draw the wine from the wine containers, and use an electric motor to turn a set of rollers, which compress and release flexible tubing as they rotate. This squeezing action creates a vacuum that draws fluid through the tubing. A solenoid valve maintains the vacuum when the pump is idle. As the pumps draw wine from the wine containers, the wine containers are deflated, ensuring wine is not displaced by oxygen. In addition, the peristaltic pump helps prevent contamination because the wine being pumped remains inside the tubing at all times and never comes in contact with any pump gears, seals, diaphragms, or other moving parts. While separate pumps for each wine variety in each outlet nozzle are illustrated in the present invention, it is contemplated that one pump, appropriately connected to the wine delivery tubes, could serve to pump the wine dispensers. By way of illustration, tubing may be utilized that contains an inner liner surrounded by a seamless extruded barrier. The inner liner preferably offers permeation resistance to flavors and gases and is certified under standard NSF-51 for food equipment and NSF-61 for drinking water systems. Tubing may be used that has a permeability coefficient of 200 and complies fully with the requirements of USP Class VI, European Pharmacopeia 3.2.9 and FDA All tubing connection points in the unit may feature a smooth inner bore fitting. A connection between tubing and a conventional fitting with a blunt end can create a dead spot in the flow path where the blunt end of the fitting and the tubing interface, and fluids can collect in this dead spot. Conversely, a smooth inner bore fitting, when used in conjunction with a retainer, for example a BarbLock, may be used to form a compression seal between the fitting and the tubing that eliminates the dead spot in the flow path. This helps prevent bacterial growth and ensure a consistent flow.

Figure 7:
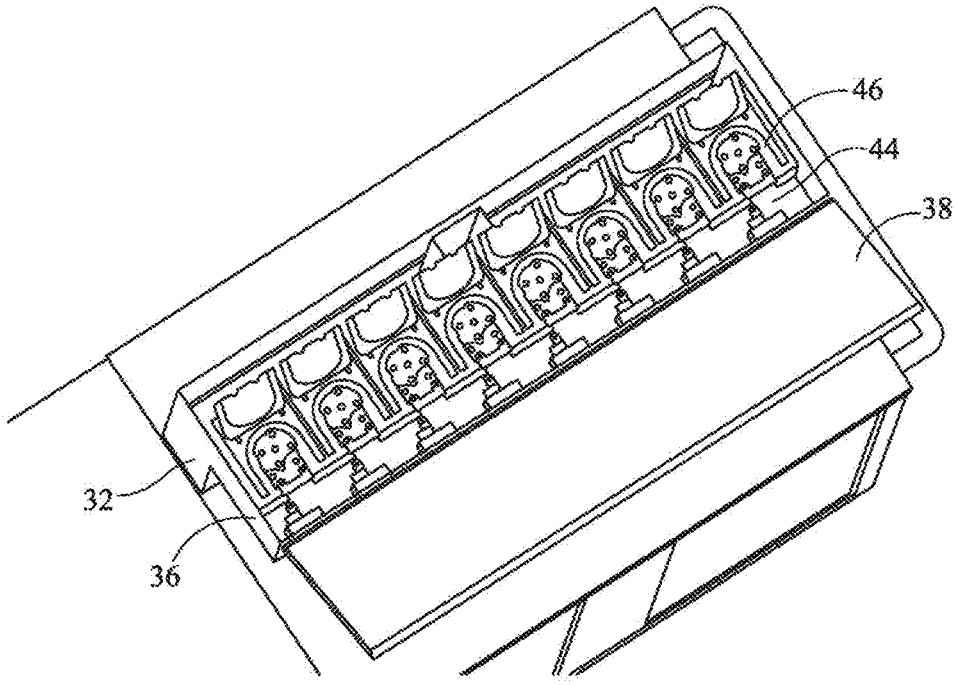
FIG. 7 is a perspective top view of the wine dispenser cabinet of FIG. 6, with the top open and showing the wine dispensers in the interior of the cabinet.

FIG. 7 depicts the interior of the forwardly extending dispenser housing 36 of the wine dispensing housing 32. Individual wine dispensing units 44 include positive displacement pumps 46 located in the interior and connected to outlet nozzles that extend downwardly through the housing. Upon being activated by the pressing of a wine selection button 50, the associated pump will begin pumping wine to the associated outlet nozzle until the desired amount of wine has been poured. Although the preferred embodiment uses positive displacement pumps that dispense a known quantity of fluid per unit of time, other pumps may be suitable for the invention, and other means for measuring quantities being dispensed may be used. In addition, a manual activation button may be used that will activate the pump for as long as the button is held down, thereby permitting the dispensing of wine in quantities other than those automatically dispensed in accordance with predetermined criteria.

Figure 8:
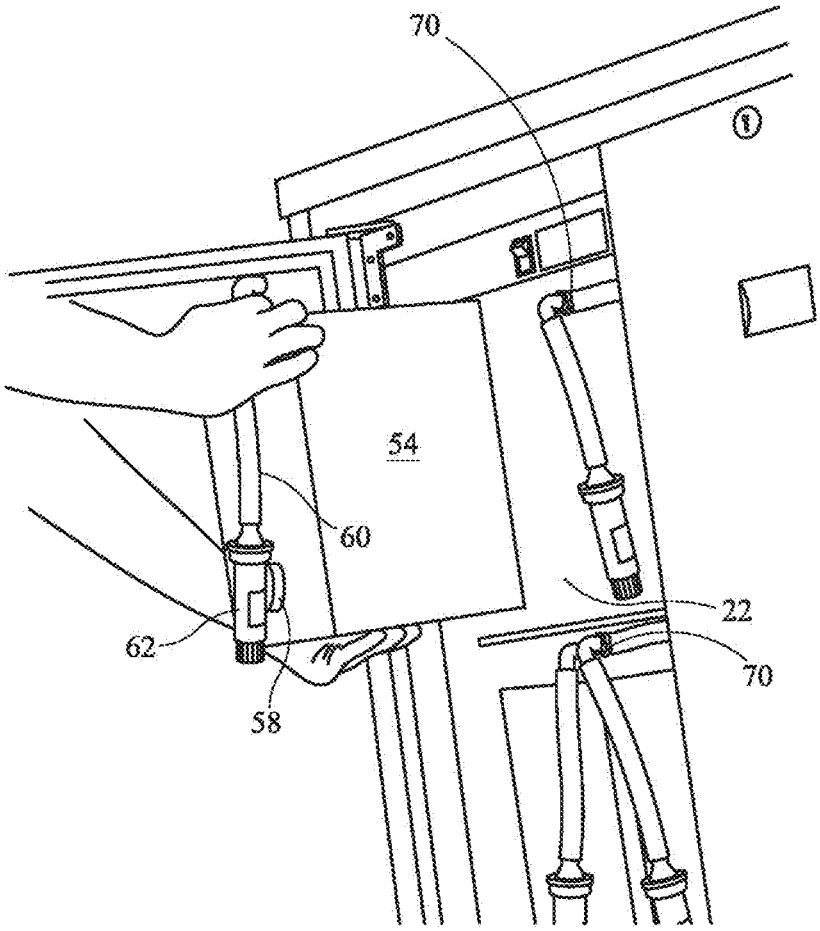
FIG. 8 is a perspective view of a wine container and outlet valve thereof with a connector for connecting the wine container to a delivery hose being shown adjacent the outlet valve.

FIG. 8 shows a wine box 54 having a wine box outlet fitting 58 that connects to delivery hose 60 with a connector 62 that interfaces with connector 58 to form a right angle connection. The wine box 54 is being inserted into a refrigerated storage receptacle 22. The wine containers 54 of the present invention include a flexible, collapsible interior container contained in a rigid shell or box. These products are known and are commonly referred to as "bag-in-a-box" containers. The advantage of these containers is that they are inexpensive, can hold up to a case of wine in one container, and will preserve the wine in a substantially oxygen free environment, so that the wine can remain fresh for up to twelve months. Conventional wine in a bottle is very susceptible to oxidation and can deteriorate substantially in a short period of hours or days.

It is known to package wine in this manner. However, the outlet valve for such containers can be problematic. In a typical bag-in-box wine container, an outlet valve mounted in the side of the container typically has a connector opening that is aligned with the interior of the container. A spigot connector or delivery tube connector typically is connected to the box outlet by pushing the connector inwardly against the side of the box. If the connector does not latch readily or if the connector is pushed too hard, the connector on the side of the box can be pushed inwardly inside the box and is thus inaccessible.

In the present invention, an improved connector such as, but not limited to, the improved connector disclosed in my co-pending patent application 61/438,500, filed Feb. 1, 2011, overcomes this problem.

Figure 9:
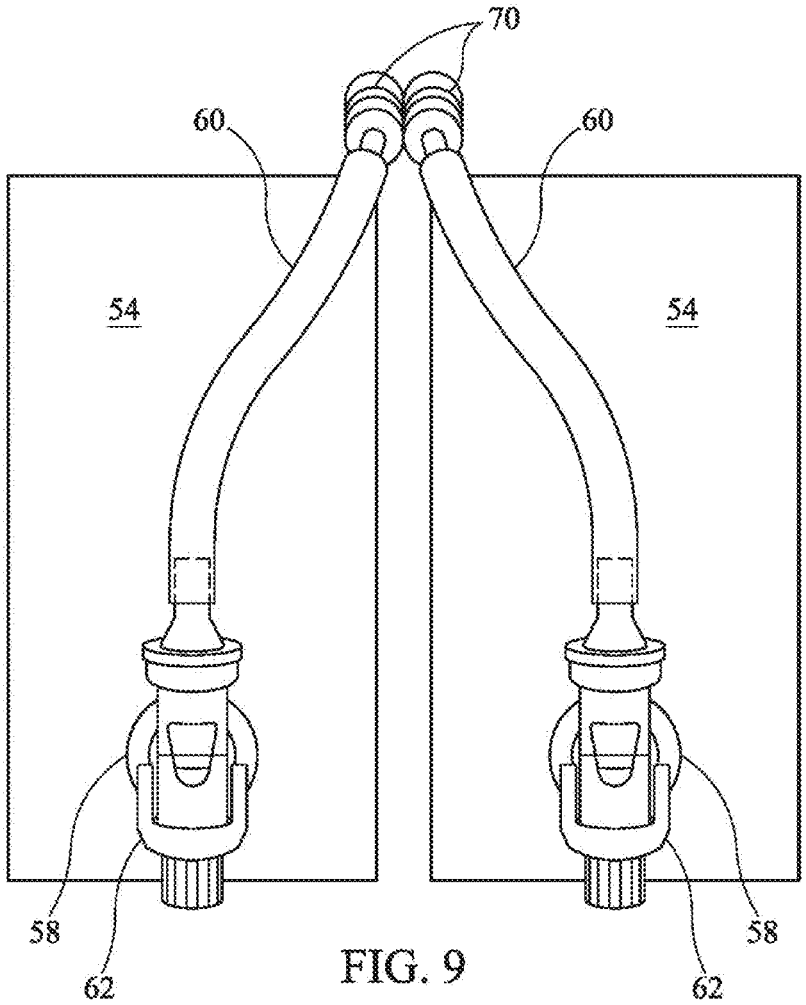
FIG. 9 is a front view of two wine containers with outlet valves and delivery hoses attached.

Referring to FIGS. 8 and 9, wine container 54 comprises a box which may be formed of cardboard or other conventional material. This box will be installed inside the refrigerated wine storage compartment 22. A box outlet fitting 58 is mounted in the side of the box. Outlet fitting 58 attaches to a connector 62 on a delivery hose 60 to form a right angle connection, such that wine flows out of the box and then turns at a right angle in fitting 58. The wine dispenser is connected to box 54 by a delivery hose 60 that has a connector 62 on the end. The connection between delivery hose 60 and the internal hosing in the cabinet incorporates a check valve 70 to prevent wine from flowing backward, out of the cabinet, and to prevent air or oxygen from entering the cabinet hosing.

Figures 10A, 10B, 10C:
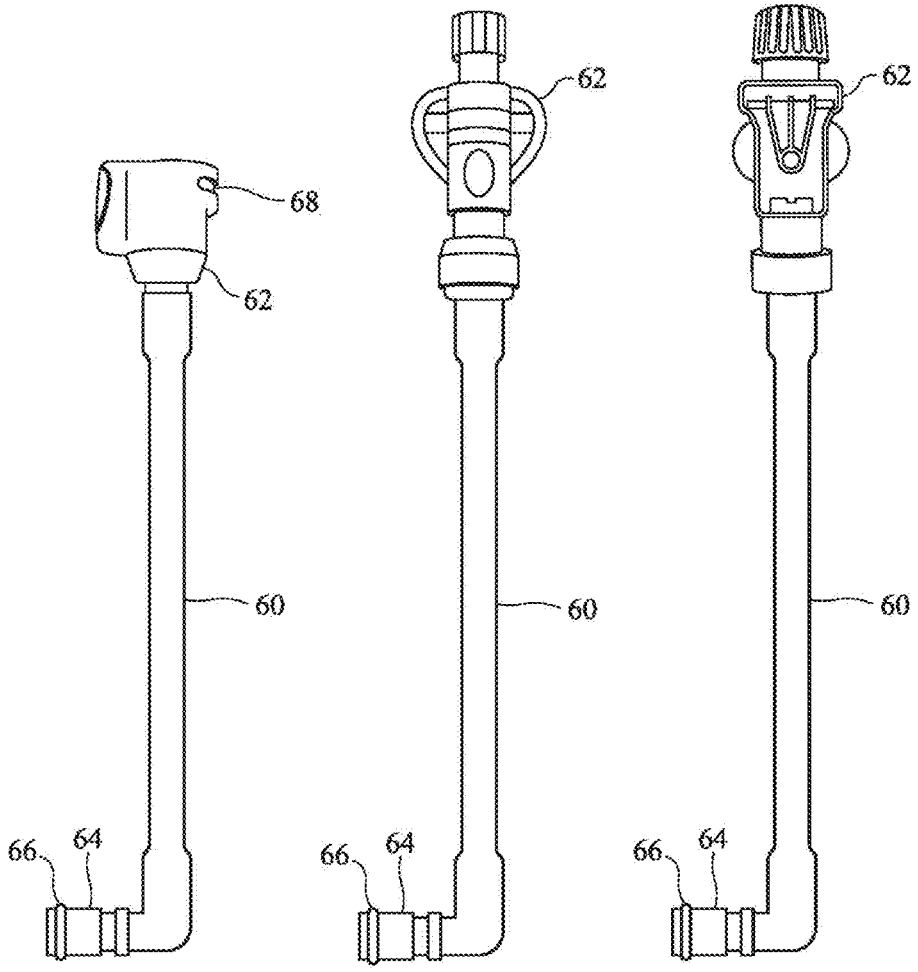
FIG. 10A-10C are detailed views of three embodiments of connecting valves having releasable fittings.

FIG. 10 depicts three embodiments of connectors 62 that will form a right angle attachment when connected to wine box outlet fitting 58. FIG. 10A is an embodiment in which a check valve 68 is incorporated into the connector 62. Connector 62 forms a right angle connection with wine box fitting 58, as shown in FIG. 8, and is also connected to delivery hose 60. Delivery hose 60 is a short hose that connects to other internal hoses within the wine dispensing cabinet. As shown in FIG. 10, delivery hoses 60 may have different connectors 62 at one end where connections are made to wine box outlet fittings 58. This permits the wine dispensing cabinet to use box wines from different wine producers having differently configured outlet fittings 58. However, delivery hoses 60 have identical fittings 64 at the end opposite the wine box connectors, where the hoses attached to the wine dispensing cabinet. Fittings 64 have an inner end connector and an O-ring seal 66 that are received into sockets in the internal hoses of the wine dispensing cabinet. Each socket has an additional check valve that is pushed opened when contacted by fitting 64. Check valve 70 prevents wine or air from backward flow through the system, and protects unused wine from oxygen deterioration. In this manner, when wine boxes are changed, no air will enter the system, and wine in boxes being removed will remain fresh and can be reinstalled at a later time with no degradation in the wine quality.

FIGS. 10B and 10C depict industry-standard connectors that interface with wine box outlet fittings 58. All connectors form a connection that is at right angles to the box outlet fitting 58, thereby relieving stress on wine box outlet fitting 58 to avoid pushing it backwards into the box during installation.

Another feature of the wine box container of the present invention is that the container is especially resistant to oxygen infiltration and therefore is able to preserve wine for up to twelve months. Check valves permit wine to be withdrawn from the container by vacuum, and prohibit the infiltration of oxygen into the flexible container. Check valves placed in the outlet fitting of the flexible container of the wine box permit the positive displacement pump to withdraw wine from the box and collapse the flexible container by applying an vacuum when wine is being dispensed. However, if the vacuum is discontinued, the check valve closes, and no oxygen will enter the container.

Another feature that makes the wine container of the present invention less permeable is the application of an oxygen resistant coating to the flexible container, which is usually a plastic bag. The oxygen resistant coating is a substance commonly referred to as EVOH (Ethylene Vinyl Alcohol). This provides an oxygen barrier for improved packaging and shelf life of the wine.

In another embodiment of the present invention, the wine boxes are provided with a computer readable bar code that contains all of the relevant information about the wine contained in the box, including the identity of the wine and any other relevant information that might be desired about the wine or the customer. The bar code can be a two or three dimensional bar code, or can be any other suitable medium that can be scanned or sensed by an appropriate scanner or sensor. The wine dispenser itself includes a bar code scanner or sensor that reads the bar code whenever a box is installed in the wine dispenser. Thus, the wine dispenser knows what wine was installed, in what storage receptacle the wine is located, when installation occurred, and how much wine is contained in the box. This information is transmitted to an internal or external (or both) computer controller. The computer controller also receives input from the pumps, dispenser nozzles, or other measuring device, and thus keeps track of the amount of wine dispensed through each nozzle. The computer controls also can receive information from a credit card reader or other payment medium in order to keep track of the payments received and compare them with quantities of wine dispensed. This computer information can be made available to the onsite operator of the wine dispenser. Also, the same information can be transmitted wirelessly or in any other conventional way to an offsite control center, where the wine dispensing systems of one or many wine dispensers can be monitored.

Figure 11:
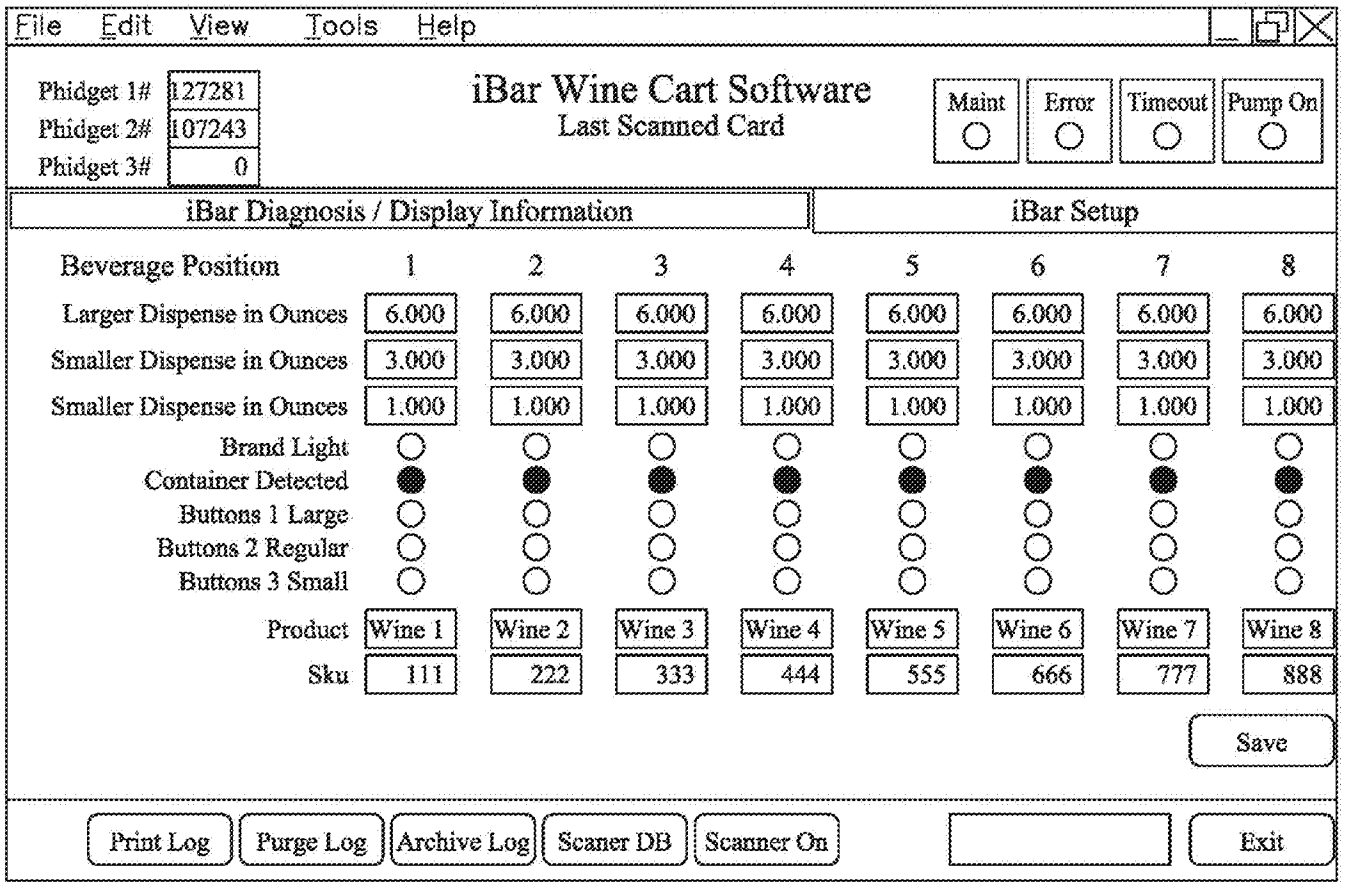
FIG. 11 is a computer monitor screen showing a beverage dispensing setup screen.

FIG. 11 depicts one embodiment of a computer display that may be attached to, or used at or near the wine dispensing cabinet to give real time information regarding the status of the cabinet. Through such an interface, pour quantities may be established, diagnostic tests may be performed, installed wine boxes may be identified, and other desired information can be monitored or modified.

Figure 12:
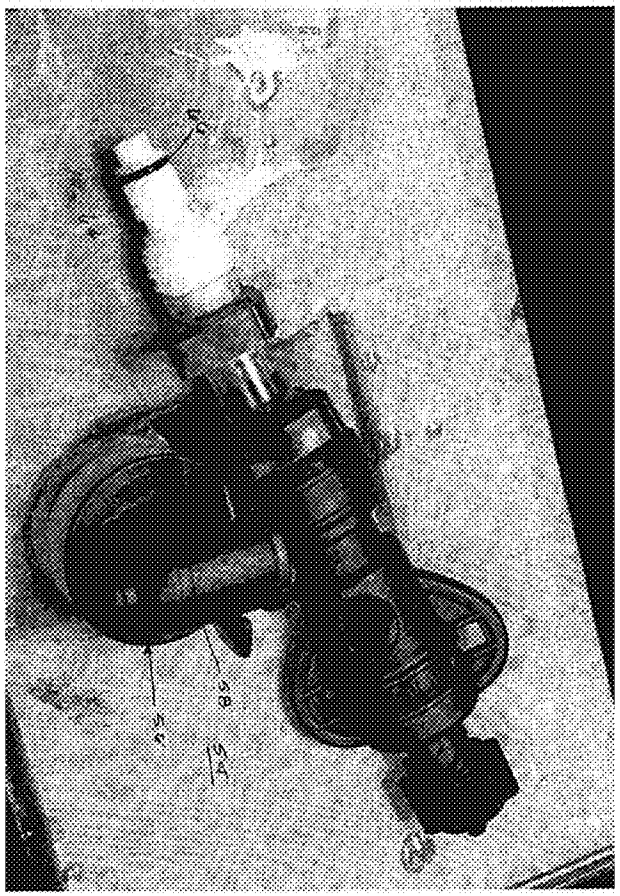
FIG. 12 is a perspective view showing a wine container with an outlet valve.
Figure 13:
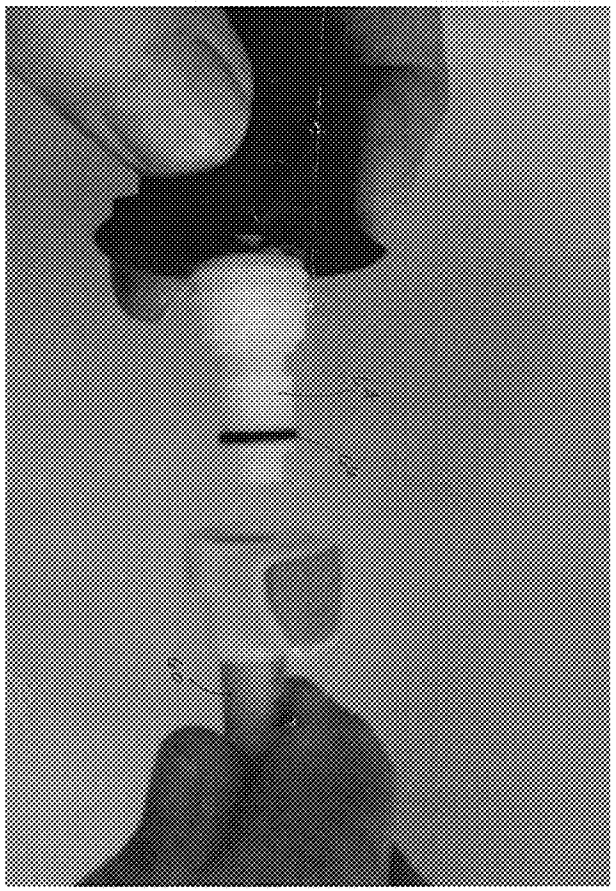
FIG. 13 is a perspective view showing a wine connector being connected with an outlet tube by a releasable fitting.

Referring now to FIGS. 12-13, the wine container 24 comprises a box 54, which may be formed of cardboard or other conventional material. This box is housed inside the wine storage compartment 22. A box outlet fitting is mounted on the side of the box. The outlet fitting has a right angle connector at an outer end, such that wine flows out of the box and then turns at a right angle in fitting 58. The wine dispenser is connected to a box 54 by a delivery tube 60 that has a connector 62 on the end. The connector 62 (FIG. 12) has an inner end 64 with an O-ring seal 66 on the end thereof that fits into the right angle connector 58 in the box outlet. Thus, when the tube connector 62 is connected to the box, the thrust is at right angles to the box and does not force the box outlet valve into the box. Preferably, quick-coupling connectors are utilized that are composed of Acetal, and contain an integral check valve that ensures oxygen does not enter the bag.

Figure 14:
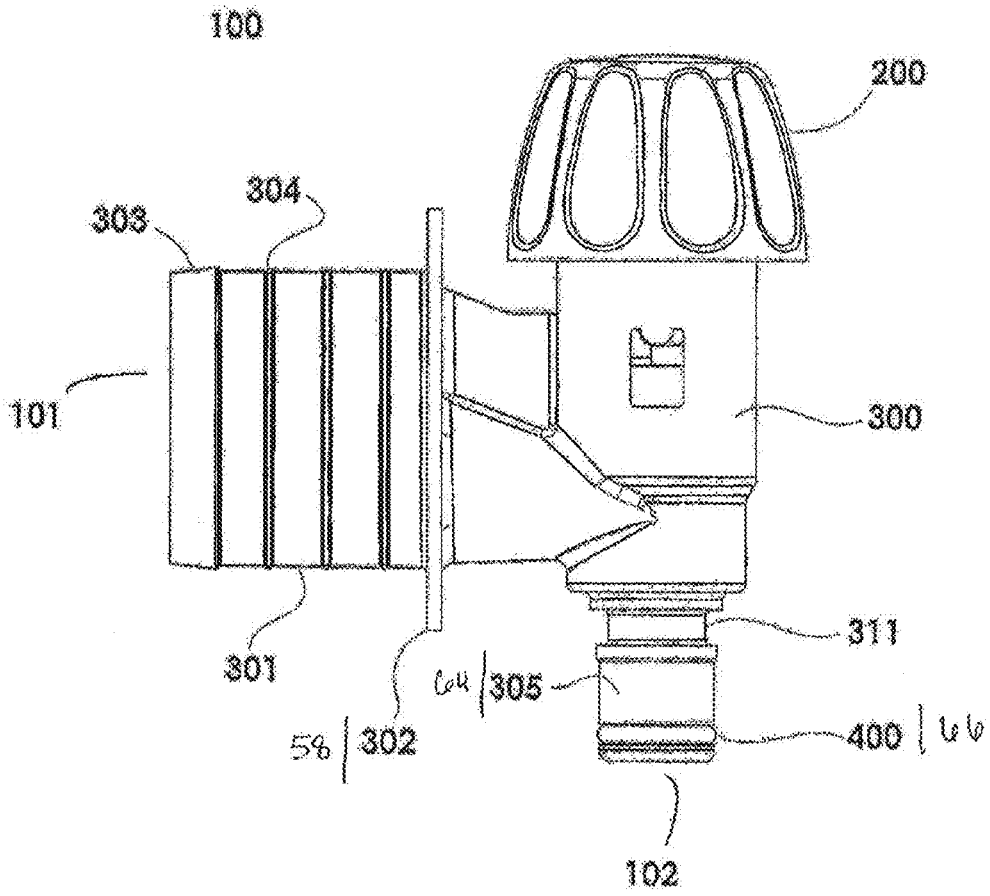
FIG. 14 is a side view of an embodiment of an outlet tap for a wine container.

As illustrated in FIG. 14, an external side view of an exemplar embodiment of the trifunction dispensing tap 100 comprises valve cap 200, a tap body 300, and a sealing means 400. Sealing means may be O-ring seal 66. Tap body 300 serves to be the intermediary which allows fluids to transfer from a bag-in-box reservoir 101 to the dispensing container or dispensing conduit 102. The tap body is preferably integrally molded from a thermoplastic resin such as polyethylene or polypropylene, but can be molded from numerous materials such as rigid polyurethane, acetal, polyphenylene oxide, polyester, polyamide, polyphenylene sulphide, polyethylene terephthalate, ABS, polycarbonate, and polysulphone. Numerous criteria are considered when choosing a polymer such as cost, ease of molding, oxygen permeability, flexibility, strength, chemical resistance, and operational temperature. Polyolefins such as polypropylene and polyethylene are commonly used for similar types of single-method dispensing taps. It is of particular interest that a resin be chosen for its structural behavior near or below freezing temperatures. Polypropylene becomes very brittle at these temperatures and can shatter like glass if stressed while at or below freezing temperatures, but has good strength and rigidity at above freezing temperatures, which is desirable. High density polyolefins can approach the stiffness of polypropylene but will not become brittle when subjected to freezing conditions, therefore HDPE is presently preferred. Valve cap 200 is preferably integrally molded from a thermoplastic resin similar to tap body 100. However, it is desirable to choose a lower density polyethylene, such as LDPE so as to from a variety of low durometer elastomeric materials such as Butyl, Buna-N, EPDM, Nitrile, Silicone, Neoprene, or Viton. A primary consideration is given to the material's low-cost performance given the particular fluid's chemical characteristics. Given these considerations, 70-80 durometer EPDM is a practical choice for fluids such as wine. Tap body 300 comprises inlet end geometry 301 to sealingly adapt to gland fitment which is welded to and part of the bag-in-box reservoir. The gland is typically made from HPDE and has a hollow bore such that tap body lead-in feature 306 (shown in FIGS. 6 and 8) can press into and deform the gland bore slightly as the tap body is inserted up to the depth of the limit flange 302. As tap body 100 is inserted, the at least one sealing rib 304 makes a liquid-tight seal from the tap body 100 to the gland bore. Tap body 100 has a dispensing outlet 305 which serves to direct fluid exiting the tap and allows a connection means to a suitable receivably engaging adapter 500. Dispensing outlet 305 has a groove to accept sealing means 400, which may be a rubber or plastic gasket or any other suitable O-ring known in the art, and provides for a retention feature 311 to secure the adapter 500.

Figure 15:
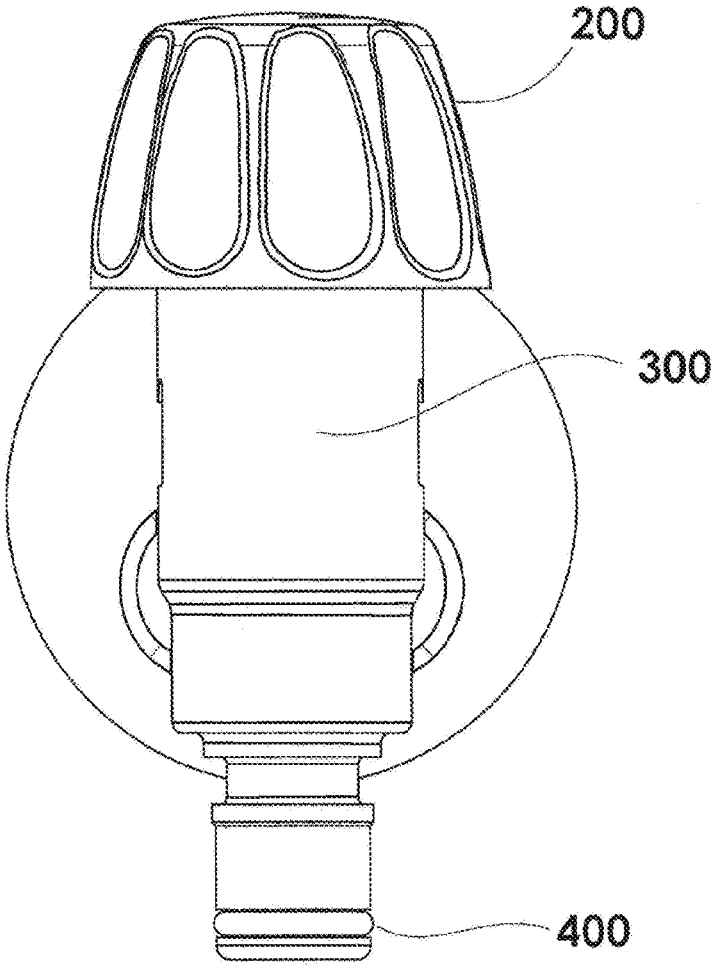
FIG. 15 is a front view the embodiment shown in FIG. 14.

FIG. 15 illustrates exemplar embodiment of tri-function dispensing tap 100 as seen from the front, its three components shown assembled. Sealing means 400 can be integrally molded into tap body 300 in the form of sealing ribs or even over-molded with an elastomeric material making the tap body 100 integral with its external sealing means 400.

Figure 16:
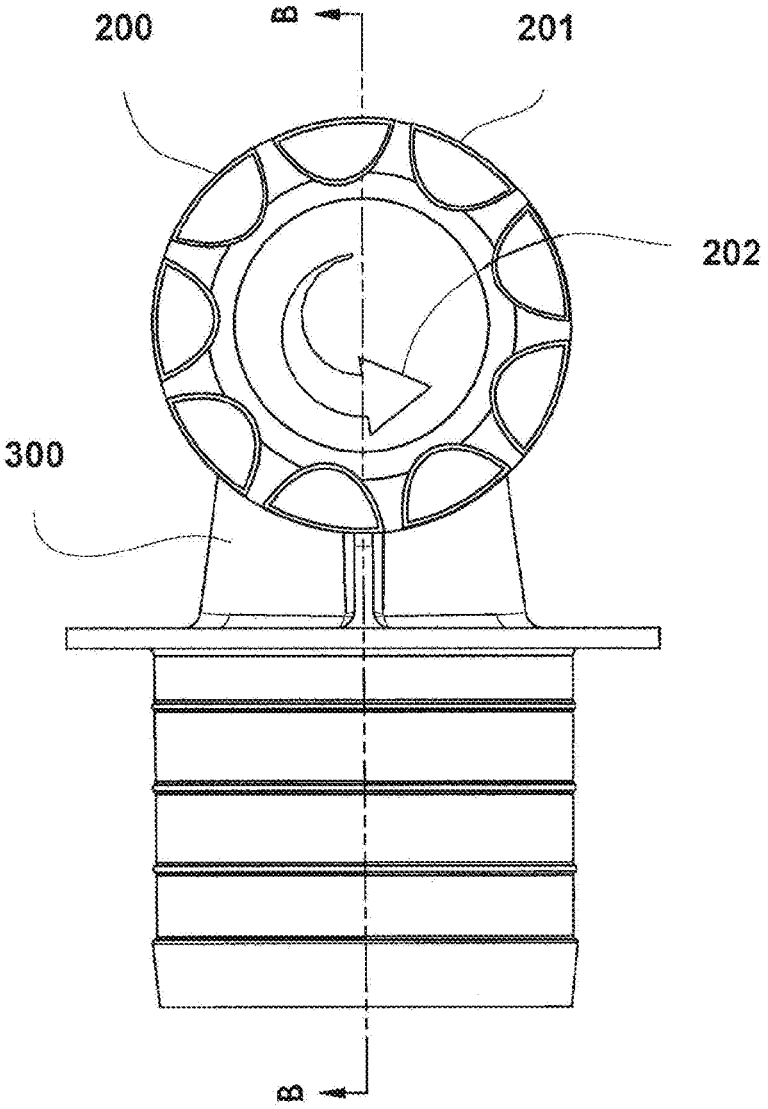
FIG. 16 is a top view of the embodiment shown in FIG. 14.

FIG. 16 illustrates the tri-method dispensing tap 100 as seen from the top. The valve cap 200 is shown with a fluted hand knob whose large diameter and, in the embodiment depicted in FIG. 16, deep depressions 201 provide substantial hand gripping contact forces to twist the knob clockwise to close, and anti-clockwise to open. The direction of rotation of valve cap 200 to open the valve is a matter of design choice, and may be either direction. Directional indicator 202 is molded into the valve cap 200 knob such that the direction and flow amount are symbolized in an increasing width curved arrow. As the arrow is curving anti-clockwise and growing larger, the corresponding flow rate becomes greater. The view from section line B-B is shown in FIG. 6.

Figure 17:
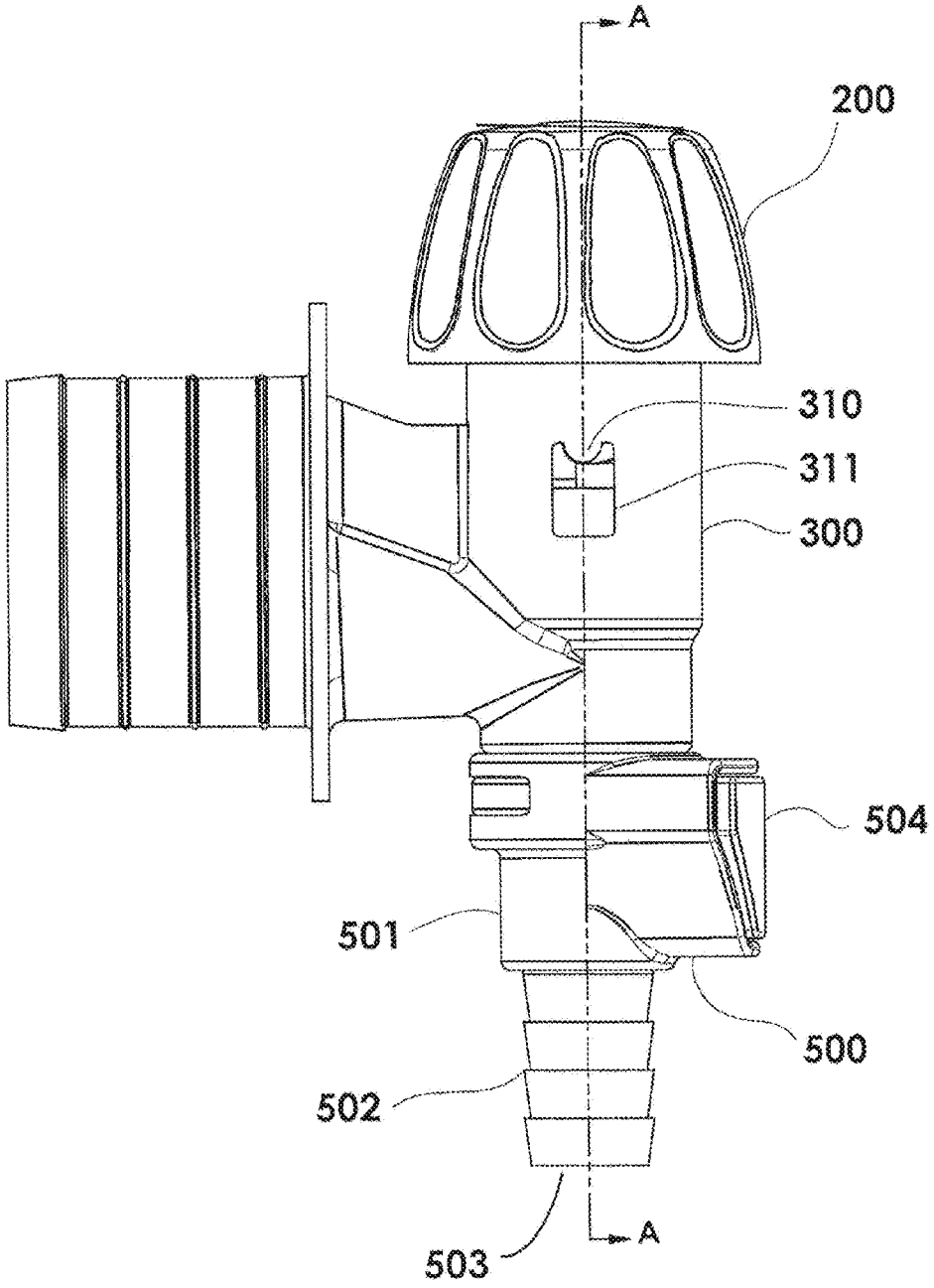
FIG. 17 is a side view of an alternative embodiment showing the tap configured to deliver liquids to an outlet tube of a pumping system.

FIG. 17 illustrates an embodiment of the tri-method dispensing tap 100 as seen from the side with receivably engaging adapter 500 attached. Adapter 500 depicts a generic variety of connector with a female socket 507 and a male hose barb 502. Adapter body 501 provides features for lockingly engaging tap body dispensing outlet 305 by actuating quick-release button 504. Sealing means 400 provides for a radial compression seal with adapter socket 507 as shown on FIGS. 5 and 6. Tap body 300 is provided with at least one rotational engaging means 310 such as a helical thread, bayonet tab, cam boss, or the like. Tap body window 311 is useful in injection molding to provide for a moldable feature such as the cam boss depicted for rotational engaging means 310.

Figure 18:
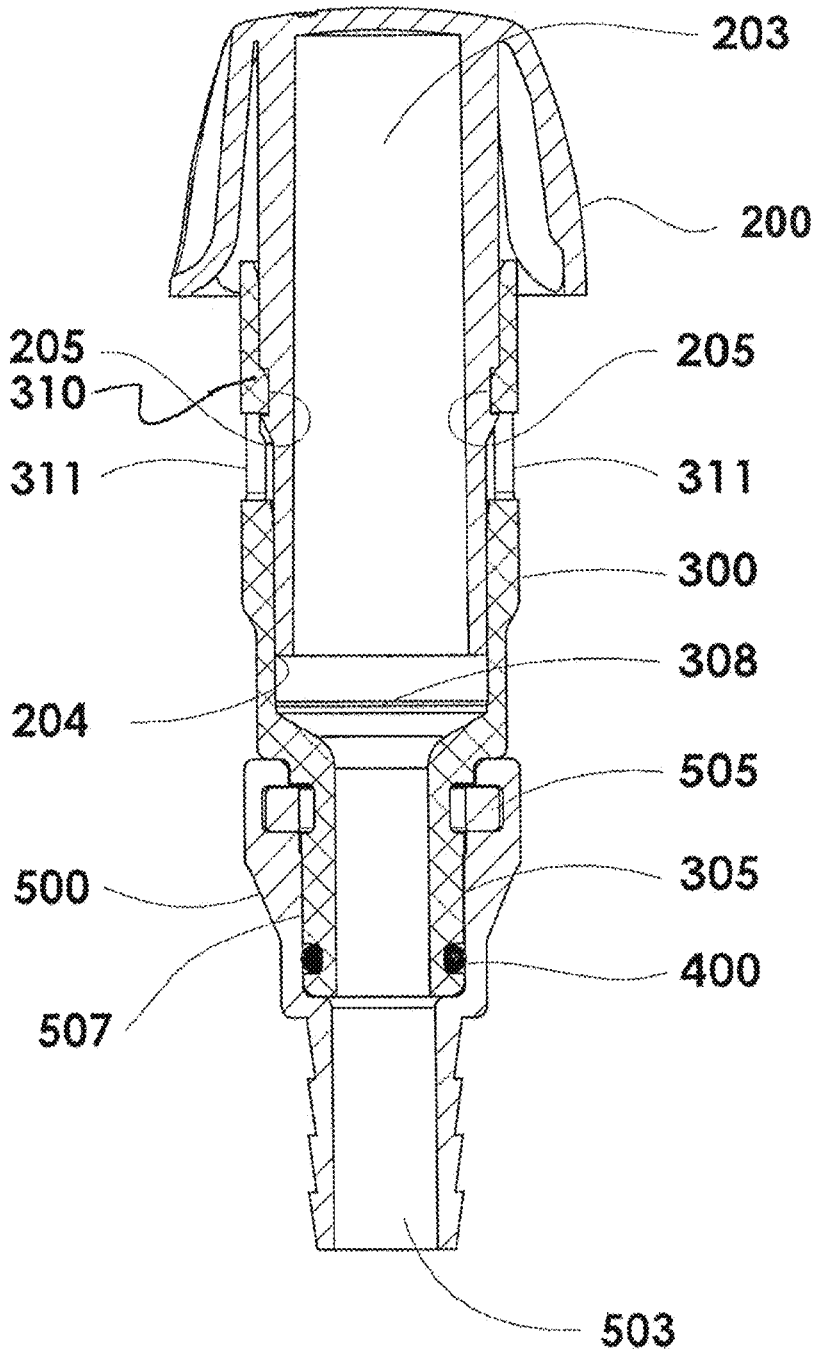
FIG. 18 is a front sectional view taken along line A-A of FIG. 17.
Figure 19:
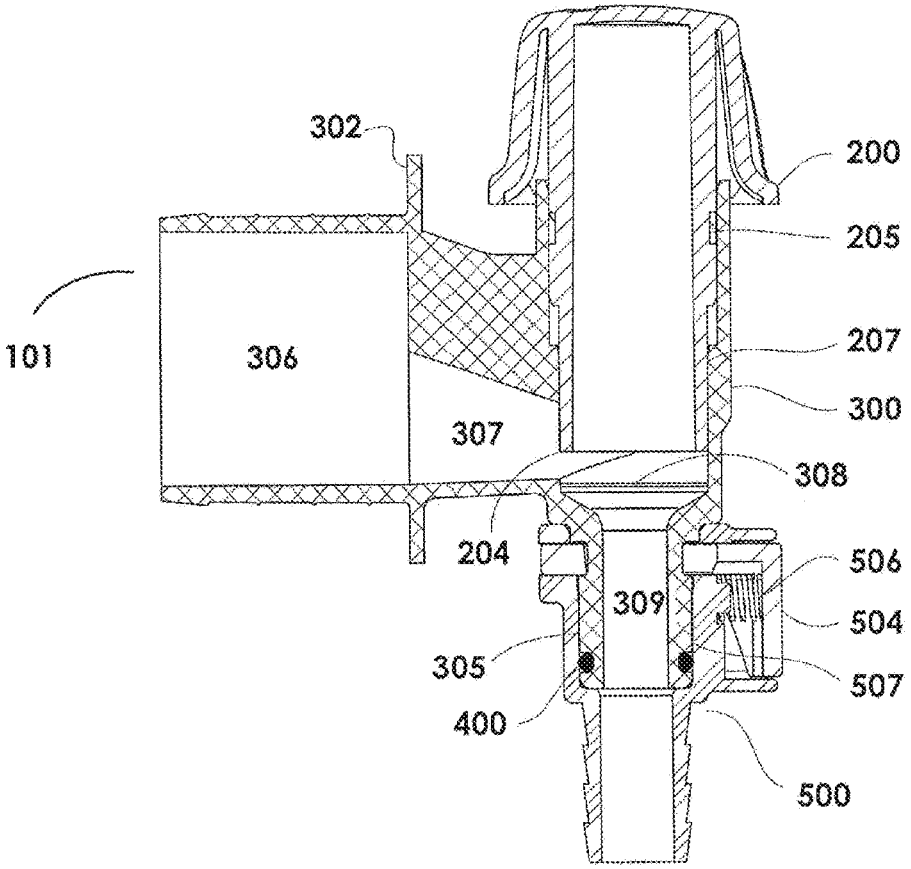
FIG. 19 is a side sectional view taken along line B-B of FIG. 16.

FIG. 18 illustrates the tri-function dispensing tap in cross-section A-A, taken from FIG. 17. Adapter 500 is shown as attached and locked in place with sealing means 400 shown as compressed in a radial fashion between adapter socket 507 and dispensing outlet 305. Adapter 500 has exit port 503 for providing a leakproof outlet for fluid flow. Typically, adapter 500 is attached to a flexible tube via the male hose barb 502. Additionally, FIG. 5 shows the valve cap rotational engaging means 205 in communication with tap body rotational engaging means 310. The at least one valve cap rotational engaging means 205 is depicted herein as a cam track which provides for a helical path imparting vertical or axial motion when valve cap 200 is undergoing rotation. When the valve cap rotational engaging means 205 are rotated anti-clockwise against the static cam boss 310, the valve cap ascends outward and upward. Any features such as a helical thread, bayonet tab, cam track, boss, or the like are preferably limited to provide the necessary valve lift within 90 to 180 degrees of rotation and preferably no more than 90 degrees to allow quick, easy, and intuitive ¼ turn valve operation. Valve seat 204 rotates and descends into tap body seal 308. Seal 308 is configured to provide for a deforming leak-tight fitment to valve seat 204.

FIG. 18 illustrates the tri-function dispensing tap 100 in a cross-section B-B from FIG. 16. This view shows the fluid path 101 as it comes from the bag-in-box reservoir into tap body inlet 306. Fluid from tap body inlet 306 passes into transition region 307 where the fluid stops until valve seat means 204 lifts off of tap body seal means 308 thereby opening the tri-function dispensing tap valve. Fluid then flows through tap body outlet 309 and into a drinking vessel.

Alternately, tap body outlet 309 allows fluid to flow into adapter 500 as shown, wherein the fluid is then transported via flexible conduit for remote dispensing. Adapter 500 incorporates a spring element 506 which allows for simple push-on engagement and leak-tight connection and which requires an overriding force in latch button 504 to release adapter 500 from tap body retention feature 311.

Figure 20:
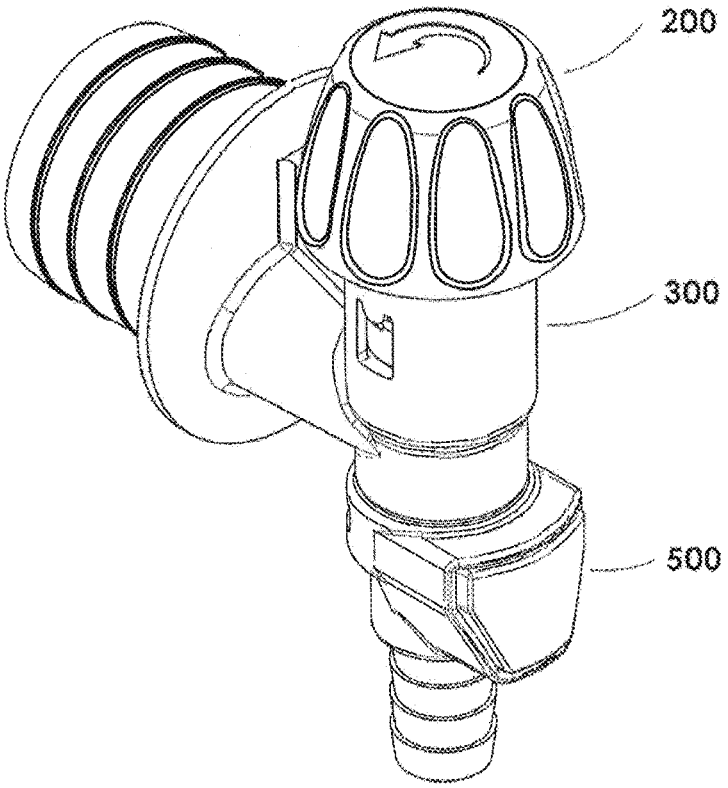
FIG. 20 is a perspective view of the embodiment shown in FIG. 17.

FIG. 20 illustrates the tri-method dispensing tap in an isometric view and depicts overall appearance and integration of the main components valve cap 200, tap body 300, and adapter 500.

Figure 21:
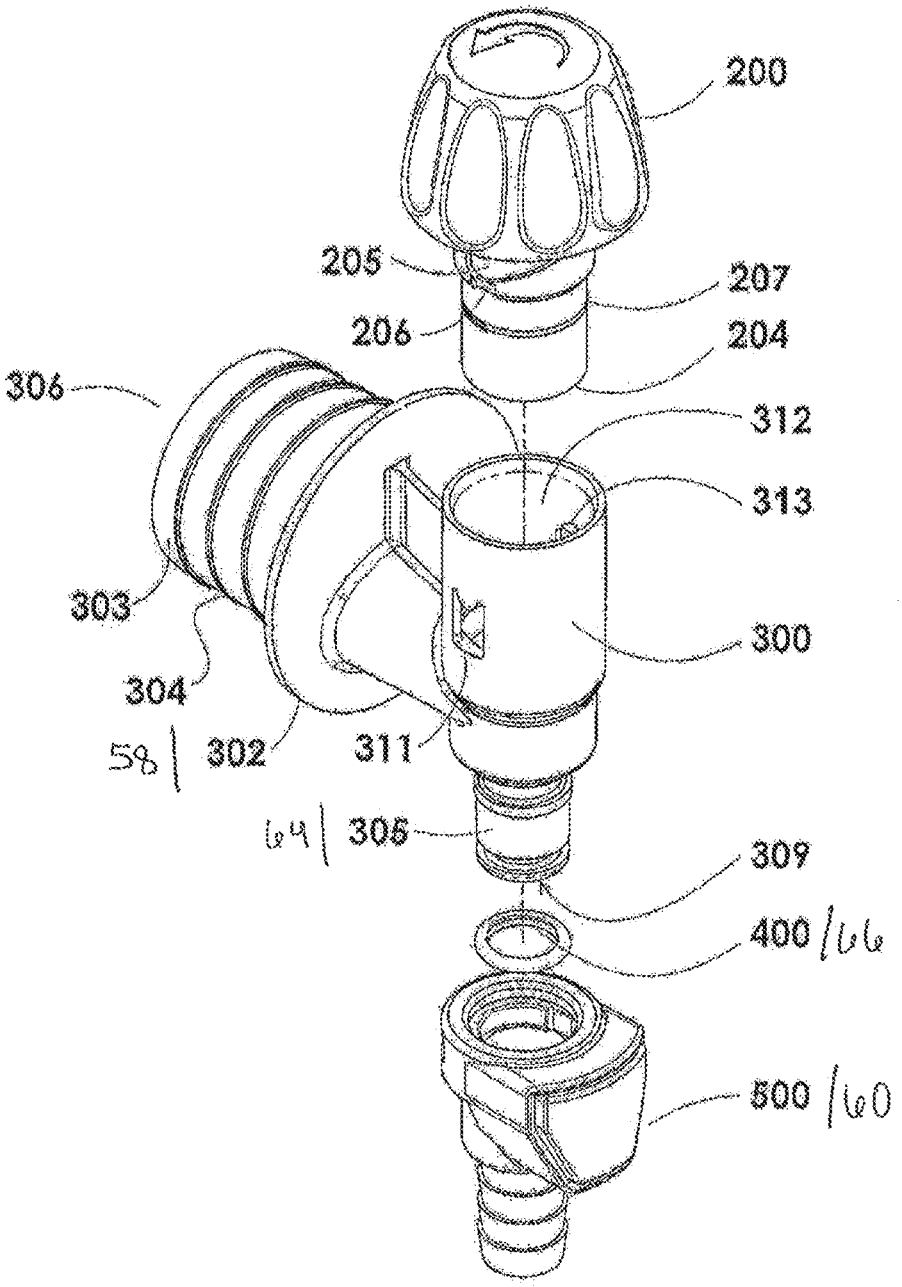
FIG. 21 is an exploded view showing the components of the embodiment shown in FIG. 20.

FIG. 21 illustrates the tri-function dispensing tap 100 in an exploded isometric arrangement and shows greater detail of the internal tap body static cam boss 310 and valve cap rotational engaging means 205. It can be seen that valve cap rotational engaging means 205 has a chamfered notch 206 to allow for initial assembly of the valve cap 200 into the tap body 300. The chamfered notch 206 allows for the valve cap to deform and jump past the tap body cam boss 310 as it is inserted during assembly. Once Cam boss 310 has jumped past notch 206, the cam boss 310 is seated securely and permanently into cam track 205. Cam track 205 can have additional features such as a ramps or a detent to give a tactile feel and locking means to prevent valve cap 200 from gradually rotating open by itself and requires an extra bit of twisting force to initiate the opening of the valve during twisting. Valve cap 200 has integral sealing means 207 which seals the valve cap 200 into the tap body smaller inner bore 312. Stiffing rib 313 adds considerable strength to tri-function dispensing tap 100 particularly when large side loads are placed onto the tap body 300 from undesirable tugging on the tube.

Figure 22:
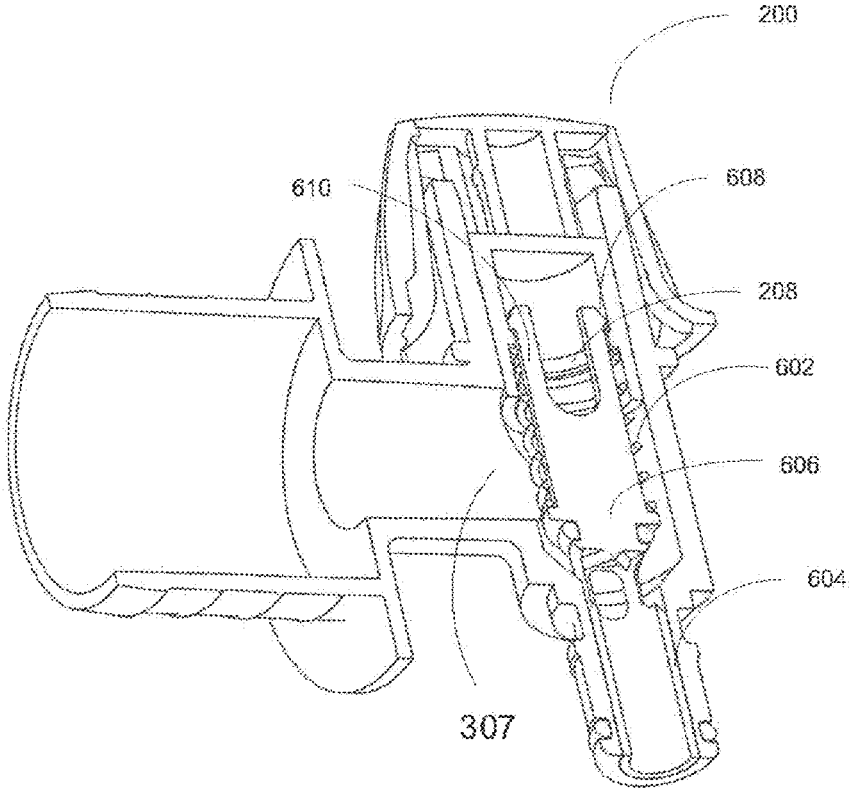
FIG. 22 is a perspective view showing a manually operated embodiment of an outlet tap having a biasing spring with the tap in an open position.

FIG. 22 depicts another embodiment of the tap of this invention in which a compression spring 602 is used to press valve 600 (shown in detail in FIG. 10) downward to shut off the flow of liquid when valve cap 200 is in the closed position. In this embodiment, valve 600 has an upper portion 606 that acts as a valve stem and that is raised (opened) or lowered (closed) as valve cap 200 is manually opened or closed, and a lower portion 604 that has passageways through which liquid may flow when the valve is open.

Figure 23:
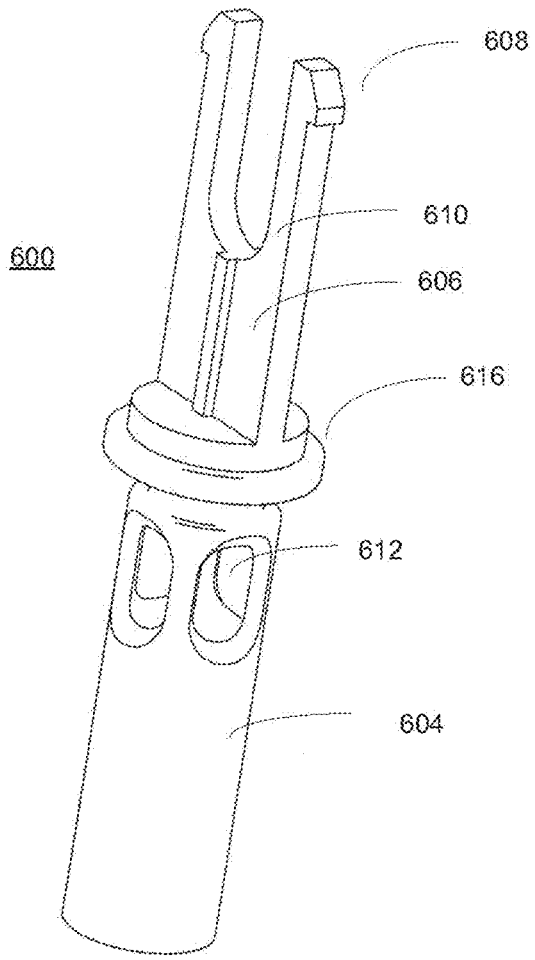
FIG. 23 is a perspective view showing detail of the valve in the embodiment shown in FIG. 22.
Figure 24:
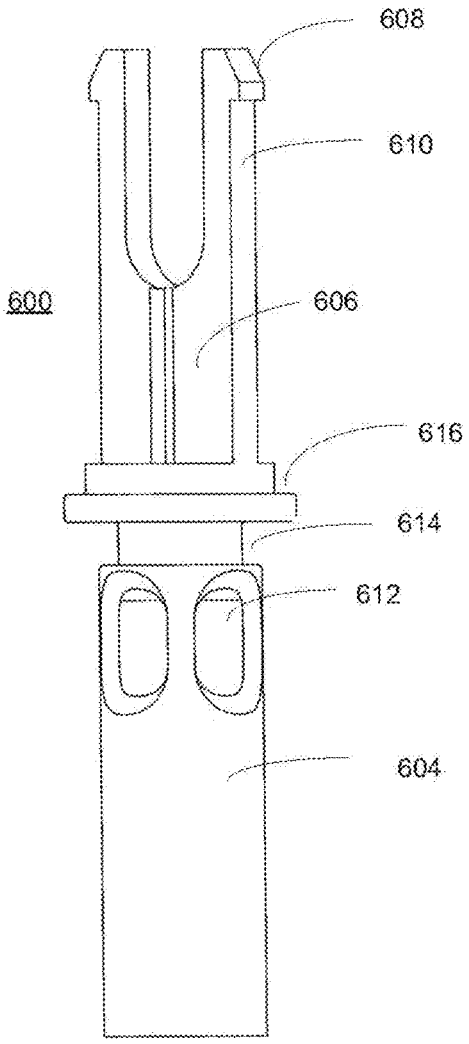
FIG. 24 is a quarter side view showing detail of the valve of FIG. 23.

FIGS. 23 and 24 provide detailed views of valve 600. An upper portion, valve stem 606, comprises two resilient fingers 610, each of which terminates in an outwardly-facing barb 608. The resilient fingers 610 and outwardly-facing barbs 608 permit easy assembly of the tap, in which valve 600 may be inserted from the bottom of the tap through exit port 309 simply by squeezing resilient fingers 610, which will snap back after insertion to hold valve 600 within the tap. Barbs 608 fit through and spring back against internal ridge 208 which runs circumferentially around the interior cavity of valve cap 200. Once installed, barbs 608 rest against the upper lip of internal ridge 208 such that, when valve cap 200 is raised to an open position, barbs 608 and resilient fingers 610 are raised to lift the lower portion of valve 604 into the open position.

The lower portion of valve 600 is a hollow cylinder 604 that has four openings, or windows 612, through which wine or other liquid will flow when the valve is in the raised, or open, position. Above windows 612 is a groove 614 to receive an elastomeric seal which may be in the form of an O-ring about valve 600. When the valve is in the lowered, or closed, position, the elastomeric seal will contact the lower, funnel shaped portion of the tap, to create a seal that prevents fluid from flowing through the tap. Above groove 614 is a cylindrical base 616 which supports valve stem 606 and provides a platform to support the lower end of compression spring 602.

Figure 25:
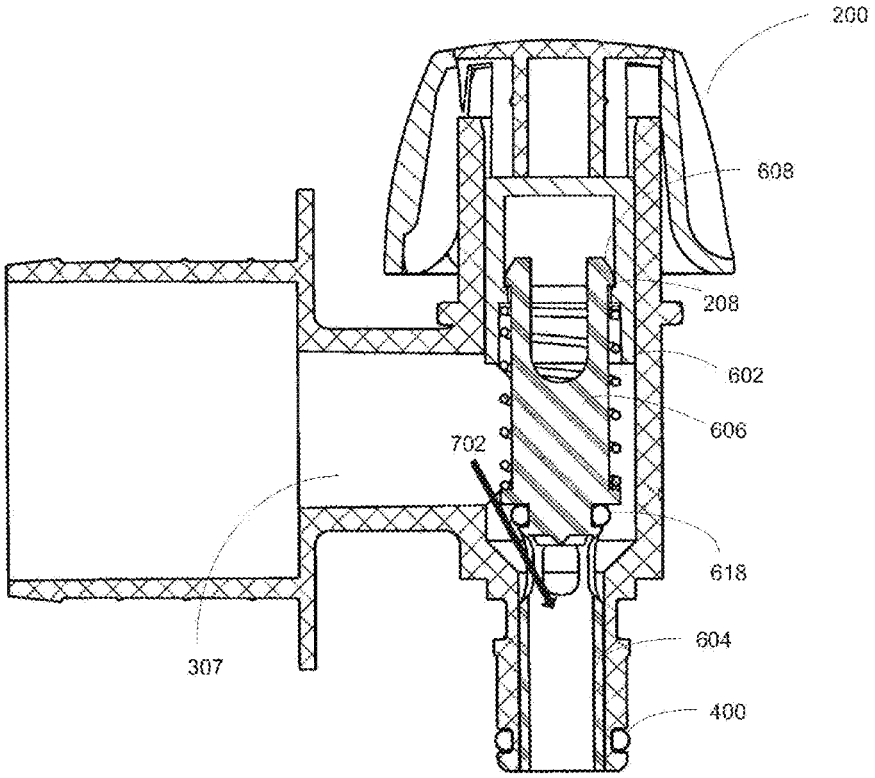
FIG. 25 is a left side sectional view of the embodiment shown in FIG. 22.

FIG. 25 is a right sectional view of the embodiment shown in FIG. 9, with the valve in an open position. Spring 602 winds helically about valve stem 606 between cylindrical base 616 and the lower surface of ridge 208, previously described as an internal ridge running circumferentially about an interior cavity in valve cap 200. FIG. 12 also shows an elastomeric sealing means 618, which may be an O-ring or any other suitable sealing means, seated within groove 614. Wine or other liquid situated in transition region 307 can now flow through the tap following liquid path 702.

Figure 26:
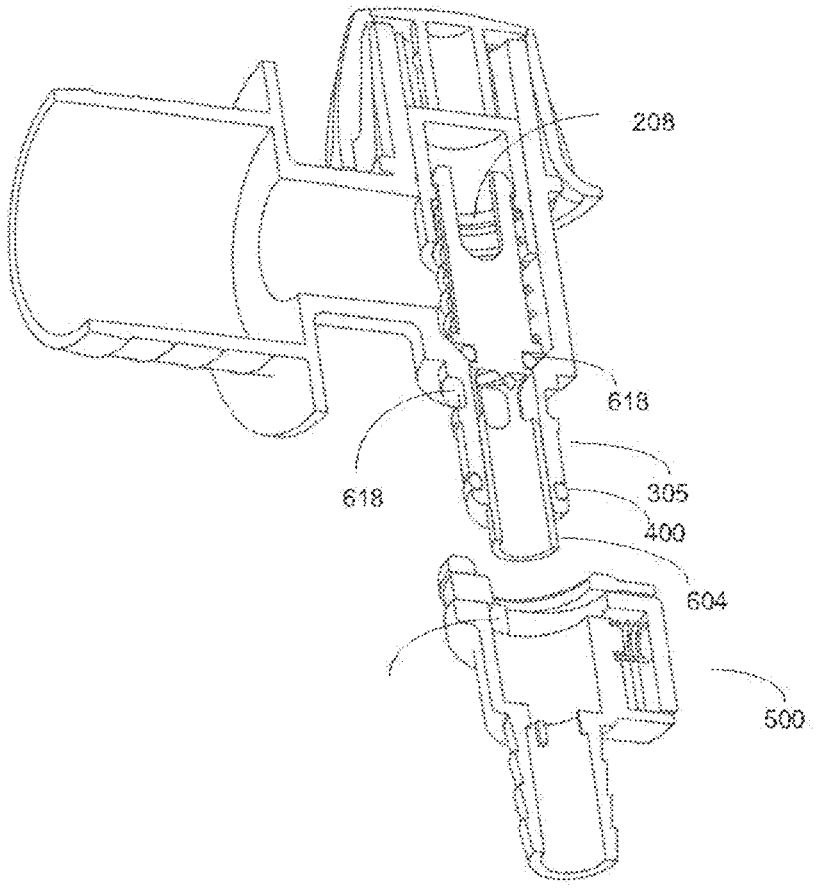
FIG. 26 is a perspective sectional view showing an embodiment having a biasing spring with the tap in the closed position and ready to receive a dispensing adapter.

FIG. 26 is a sectional perspective view showing the tap of FIG. 9 in a closed position and ready to receive automatic dispensing adapter 500. Sealing means 618 is resting against the lower portion of the internal passage through the tap and prevents liquid from flowing through the tap. Valve cap 200 is in a lowered, closed, position, and spring 602 is pressing against internal ridge 208 and cylindrical base 616, forcing valve 200 to a lowered position.

Figure 27:
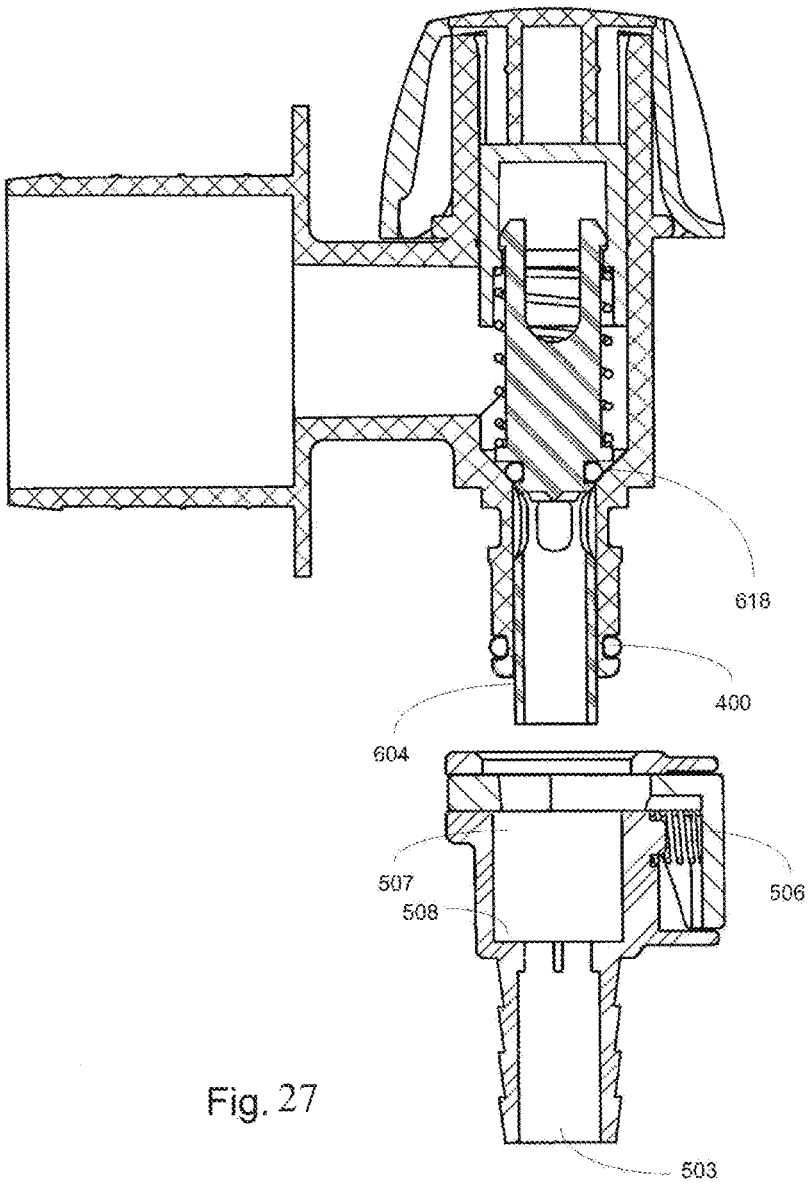
FIG. 27 is a left side section view of the embodiment shown in FIG. 24.
Figure 28:
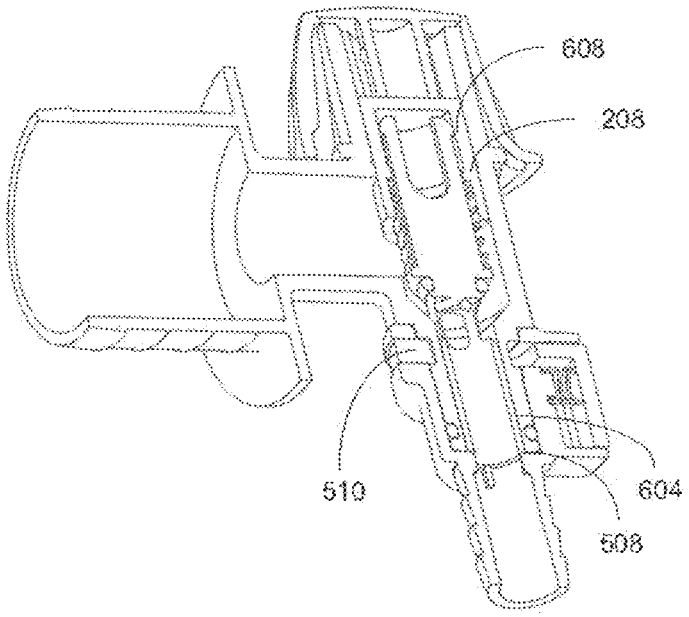
FIG. 28 is a perspective sectional view showing an embodiment having a biasing spring with the tap in the open position and the automatic dispensing adapter being attached.

FIG. 27 is a right sectional view of the configuration shown in FIG. 13, and shows tap 300 in a manually closed position and ready to receive automatic dispensing adapter 500. Sealing means 400, located at the outer surface of dispensing outlet 305 will be received in connecting socket 507 of automatic dispensing adapter 500. Connecting socket 507 has a shoulder 508 adapted to receive the lower end of valve 604 such that, when automatic dispensing adapter 500 is snugly attached to dispensing outlet 305, valve 604 will be pushed upward to the open position, and fluid passageway 702 will open, regardless of the position of valve cap 200. This configuration is depicted in FIG. 28, in which the lower end of valve 604 is resting upon shoulder 508, which has caused valve 604 to move upward, compressing compression spring 602.

Figure 29:
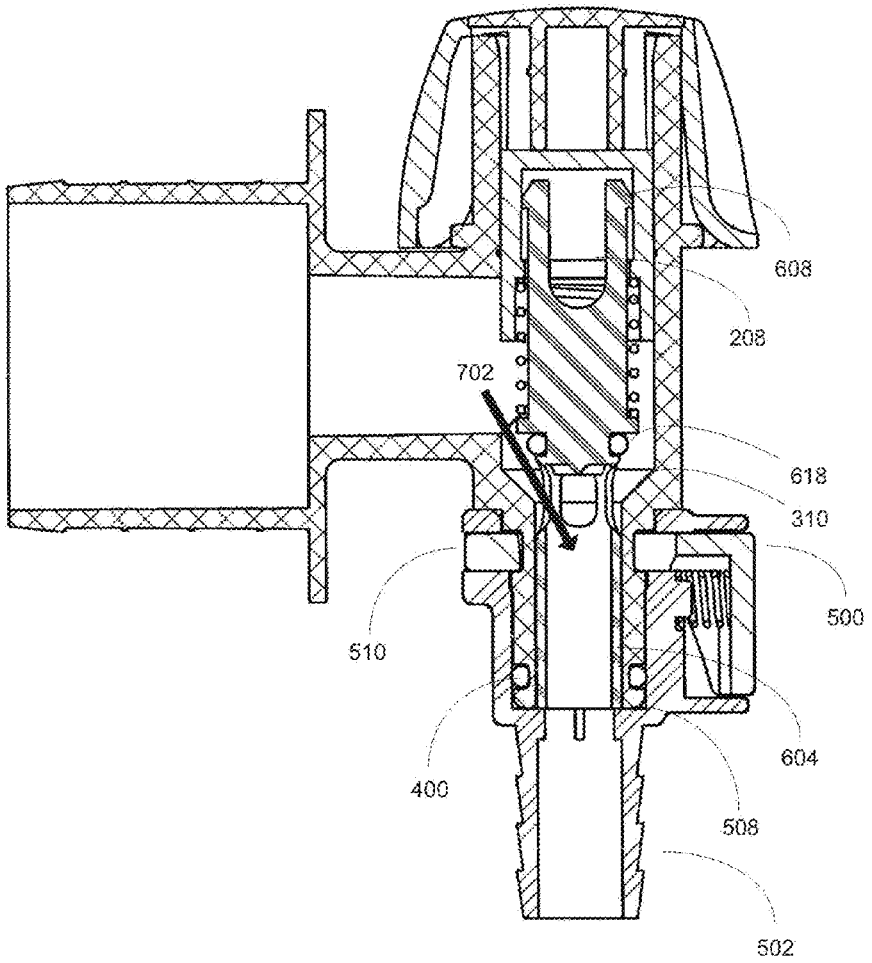
FIG. 29 is a left side sectional view of the embodiment shown in FIG. 26.

FIG. 29 shows tap 300 connected to automatic dispensing adapter 500 to create fluid passageway 702. The upward movement of valve 604 has also raised valve stem 606 and barbs 608 have moved to a position above internal ridge 208. In this configuration, the flow of wine or other fluid will be controlled by an external pump or other mechanism attached to the distal end of a tube (not shown) whose proximal end will be attached to hose barb 502.

It will be appreciated that the embodiment of tap 300 depicted in FIGS. 9-16 will always be forced open when automatic dispensing adapter 500 is attached, regardless of the manually selected position of valve cap 200. When automatic dispensing adapter 500 is released through quick fitting mechanism 504, 506, wine or other liquid may continue to flow unless valve cap 200 has been manually set to the closed position.

The tap of this invention may be used with automatic filling machinery to fill bladders with liquid such that minimal or no leakage occurs, and the filled bladders may be packaged for transportation and shipment. The embodiment of FIGS. 9-16 is particularly well suited for automated filling since the fluid path 702 is opened merely by pressing valve 604 into the tap, and fluid may then be injected into the bladder. Once filling is complete, the filling machinery may remove oxygen or ambient air, and may inject nitrogen or some other suitable gas into the bladder to equalize air pressure and prevent or reduce the introduction of oxygen into the bladder through permeation of the bladder surface. As no manual manipulation of valve cap 200 is required for such a filling procedure, the process may be automated, and the efficiency of the process will be enhanced.

The tap of this invention permits wine or other liquid to be dispensed manually or through the use of an automated dispensing apparatus. Regardless of the method used, oxygen does not come into contact with liquid that remains in the bladder, which may be preserved indefinitely without deterioration.

Another feature of the wine box containers of the present invention is that they are larger than typically normal, holding about nine liters or one case of wine. This provides packaging and expense advantages.

In addition to monitoring operations in order to confirm that all wine dispensed has been properly accounted for, the computer monitoring operation can monitor consumer wine preferences and the amount of wine consumed and can be connected to an automatic ordering system that insures that inventory will always be on hand when needed.

The descriptions set forth above are meant to be illustrative and not limiting. Various modifications of the invention, in addition to those described herein, will be apparent to those skilled in the art from the foregoing description. Such modifications are also intended to fall within the scope of the concepts described herein. The disclosures of each patent, patent application and publication cited or described in this document are hereby incorporated herein by reference, in their entireties.

The foregoing description of possible implementations consistent with the present disclosure does not represent a comprehensive list of all such implementations or all variations of the implementations described. The description of some implementation should not be construed as an intent to exclude other implementations. For example, artisans will understand how to implement the invention in many other ways, using equivalents and alternatives that do not depart from the scope of the invention. Moreover, unless indicated to the contrary in the preceding description, none of the components described in the implementations are essential to the invention. It is thus intended that the embodiments disclosed in the specification be considered as illustrative, with a true scope and spirit of the invention being indicated by the following claims.

I claim:

1. A wine dispensing cabinet comprising:

a cabinet comprising one or more compartments, an upper housing, one or more dispensing nozzles, one or more pumps, connecting hoses, one or more wine selection buttons, and a processor;

said one or more compartments further comprising one or more receptacles for receiving one or more liners to contain wine;

each said one or more liners of wine substantially isolating wine contained therein from oxygen by restricting the passage of oxygen through said liner;

said liner further comprising a connector having a check valve, said check valve forming a seal against the entry of oxygen into said liner and said check valve being opened by a vacuum created when said one or more pumps draw wine out of the receptacle;

said upper housing further comprising a forwardly extending housing of sufficient height and depth to receive one or more containers for receiving wine between a base and said forwardly extending housing with dispensing nozzles, said forwardly extending housing further comprising said one or more wine selection buttons;

said one or more dispensing nozzles being located in said forwardly extending housing and being situated to dispense wine into containers placed on said base;

said one or more pumps being one or more peristaltic pumps and being actuated by receiving a signal from said processor, the quantity of wine dispensed being determined by said one or more pumps in a measured amount of liquid per unit time of operation; and said connecting hoses connecting one or more receptacles of wine in said one or more compartments to said one or more pumps and said one or more dispensing nozzles; said connecting hoses comprising at least one delivery hose and an internal hose system; wherein said one or more compartments are refrigerated;

wherein when one of said one or more wine selection buttons is pressed, said processor sends an electric signal to one of said pumps, which creates a vacuum that causes wine to be dispensed from one of said wine receptacles through one of said connecting hoses to said one of said pumps, and further through one of said connecting hoses to one of said dispensing nozzles and to be dispensed into a container beneath said dispensing nozzle;

the at least one delivery hose connectable with the connector and coupleable with the internal hose system; a hose connector for coupling the delivery hose with the internal hose system, the connector including a second check valve.

2. The wine dispensing cabinet as claimed in claim 1, each said refrigerated cabinet further comprising a plurality of receptacles, each receptacle receiving a liner containing a different variety of wine.

3. The wine dispensing cabinet as claimed in claim 2 wherein the one or more compartments are refrigerated, and wherein the refrigeration temperature of each said refrigerated compartment can be set at a different temperature.

4. The wine dispensing cabinet as claimed in claim 2 further comprising some of said one or more selection buttons selecting a different variety of wine.

5. The wine dispensing cabinet as claimed in claim 4 further comprising some of said one or more selection buttons selecting a different quantity of a selected wine to be dispensed.

6. The wine dispensing cabinet as claimed in claim 5 wherein said quantity of wine to be dispensed is determined by measuring the volume of wine dispensed by said one or more pumps.

7. The wine dispensing cabinet as claimed in claim 5 wherein one of said selection buttons will select a wine to be dispensed continuously while said selection button is pressed.

8. The wine dispensing cabinet as claimed in claim 2, wherein said upper housing further comprising a viewing area for displaying different varieties of wine available.

9. The wine dispensing cabinet as claimed in claim 2, wherein at least one of the one or more liners provided in a wine receptacle, the wine receptacle further comprising a connector forming a right angle where said connector is connected to one of said connecting hoses.

10. The wine dispensing cabinet as claimed in claim 2 wherein said processor receives information regarding the quantity of wine being dispensed from each liner and stores said information in a database.

11. The wine dispensing cabinet as claimed in claim 2 wherein information regarding at least the age and gender of individuals for whom wine is dispensed is entered into said processor and is maintained in a database.

12. The wine dispensing cabinet as claimed in claim 11 wherein information regarding at least the age and gender of individuals for whom wine is dispensed is used to identify demographic and wine drinking preferences.

13. The wine dispensing cabinet as claimed in claim 11 further comprising a display panel wherein information regarding at least the variety and quantities of wine remaining in said wine dispensing cabinet is displayed to an operator.

14. The wine dispensing cabinet as claimed in claim 13, said display panel displaying additional information calculated or maintained by said processor.

15. The wine dispensing cabinet as claimed in claim 14 wherein said display panel is located at a location remote from said wine dispensing cabinet.

16. A wine dispensing cabinet comprising:

a countertop for receiving a container;

an upper housing extending above the countertop;

a plurality of compartments, at least one compartment refrigerated, each compartment including a receptacle for receiving at least one of a plurality of flexible liners for containing the wine, each liner substantially isolating the wine contained therein from oxygen by restricting the passage of oxygen through the liner, each liner including a connector having a first check valve, the first check valve forming a seal against the entry of oxygen into the liner;

a plurality of delivery hoses, each delivery hose connectable with the connector of one of the liners when received in one of the receptacles;

a plurality of dispensing nozzles provided in the upper housing, each dispensing nozzle connected with one of the delivery hoses through an internal hose system, the dispensing nozzle positioned in order to dispense wine from one of the connected liners into the container when received and positioned under the dispensing nozzle;

a second check valve provided between each delivery hose and the internal hose system in order to prevent the backflow of wine and in order to prevent oxygen from entering the internal hose system; a hose connector for coupling the delivery hose with the internal hose system, the connector including the second check valve;

one or more peristaltic pumps associated with the internal hose system in order to transport wine from one of the wine receptacles to the connected dispensing nozzle through the connected delivery hose without the wine contacting any portion of the pump; and a processor electrically connected with the one or more peristaltic pumps and controlled by one or more wine selection buttons provided on the wine dispensing cabinet, the processor operable to send an electric signal to the one or more pumps in order to dispense wine contained in one of the receptacles of wine into the wine glass when received and positioned under the dispensing nozzle.

17. A wine dispensing cabinet comprising:

a countertop for receiving a container;

an upper housing extending above the countertop;

a plurality of compartments, at least one compartment refrigerated, each compartment including a receptacle for receiving a flexible liner for containing the wine, the liner substantially isolating the wine contained therein from oxygen by restricting the passage of oxygen through the liner, the liner including a connector having a check valve, the check valve forming a seal against the entry of oxygen into the liner and said check valve opened by a vacuum produced by one or more peristaltic pumps drawing wine out of the liner, one or more dispensing nozzles provided in the upper housing, each dispensing nozzle connected with the connector of at least one liner of wine through at least one connecting hose in order to dispense wine from the at least one liner of wine into the container when the container is received and positioned under the dispensing nozzle; said at least one connecting hose comprising at least one delivery hose and an internal hose system; the at least one delivery hose connectable with the connector and coupleable with the internal hose system; a hose connector for coupling the delivery hose with the internal hose system, the connector including a second check valve; a processor electrically connected with the one or more peristaltic pumps, the processor controlled by one or more wine selection buttons provided on the wine dispensing cabinet, the processor operable to send an electric signal to the one or more peristaltic pumps in order to dispense a variable quantity of wine, as selected by the one or more wine selection buttons, contained in one of the receptacles of wine into the wine glass when received and positioned under the dispensing nozzle, the processor further operable to calculate the quantity of wine pumped from each received receptacle of wine, the processor further operable to identify the liner received in each receptacle and calculate the quantity of wine remaining in each received wine liner after the variable quantity of wine is dispensed.

* * * * *